US011156197B1

(12) United States Patent
Lew et al.

(10) Patent No.: US 11,156,197 B1
(45) Date of Patent: Oct. 26, 2021

(54) METHODS AND SYSTEMS FOR ENGINE CRANKING

(71) Applicant: Ford Global Technologies, LLC, Dearborn, MI (US)

(72) Inventors: David Lew, Canton, MI (US); David Hancock, Flat Rock, MI (US); John E. Rollinger, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/061,222

(22) Filed: Oct. 1, 2020

(51) Int. Cl.

| | |
|---|---|
| ***F02N 11/10*** | (2006.01) |
| ***F02D 41/06*** | (2006.01) |
| ***F01L 1/344*** | (2006.01) |
| ***F02N 11/04*** | (2006.01) |

(52) U.S. Cl.
CPC ..... *F02N 11/10* (2013.01); *F01L 1/3442* (2013.01); *F02D 41/064* (2013.01); *F02N 11/04* (2013.01); *F01L 2820/04* (2013.01); *F02D 2200/021* (2013.01); *F02D 2200/023* (2013.01); *F02D 2200/70* (2013.01); *F02D 2250/00* (2013.01); *F02N 2200/023* (2013.01); *F02N 2200/024* (2013.01); *F02N 2200/08* (2013.01); *F02N 2200/122* (2013.01); *F02N 2250/00* (2013.01)

(58) Field of Classification Search
CPC .... F02N 11/10; F02N 11/04; F02N 2200/023; F02N 2200/024; F02N 2200/08; F02N 2200/122; F02N 2250/00; F01L 1/3442; F01L 2820/04; F02D 41/064; F02D 2200/70; F02D 2200/023; F02D 2200/021; F02D 2250/00
USPC ..... 123/90.11, 90.12, 90.15, 90.16, 90.17, 123/179.3, 179.4
See application file for complete search history.

(56) References Cited

U.S. PATENT DOCUMENTS

| | | | | |
|---|---|---|---|---|
| 7,561,957 | B1 | 7/2009 | Santoso et al. | |
| 9,031,726 | B2 | 5/2015 | Otterspeer et al. | |
| 10,001,036 | B2 * | 6/2018 | Smith | F01L 1/044 |
| 10,690,019 | B2 * | 6/2020 | Wing | F01L 1/3442 |

* cited by examiner

*Primary Examiner* — Hai H Huynh
(74) *Attorney, Agent, or Firm* — Geoffrey Brumbaugh; McCoy Russell LLP

(57) ABSTRACT

Methods and systems are provided for adjusting engine cranking. In one example, a method for an engine cold start may include extending engine cranking at least based on one or more engine cold start conditions, where extending engine cranking may increase an engine oil pressure in a plurality of camshaft phaser cavities of a variable camshaft timing (VCT) phaser. In some examples, the method may further include, after engine cranking, enabling fueling. In this way, fuel efficiency considerations may be balanced with increases to the engine oil pressure such that components of the VCT phaser may be actuated and/or lubricated.

14 Claims, 10 Drawing Sheets

METHODS AND SYSTEMS FOR ENGINE CRANKING

FIELD

The present description relates generally to methods and systems for engine cranking, and particularly for adjusting engine cranking to increase engine oil pressure during an engine cold start.

BACKGROUND/SUMMARY

Among the numerous factors driving improvements in internal combustion engine (ICE) performance are desires for greater fuel efficiency (e.g., lower fuel consumption and emissions) and enhanced consumer satisfaction (e.g., improved drivability and user experience). For example, variable valve timing (VVT) may be implemented to phase cylinder intake and exhaust valve opening and closing such that intake and exhaust gas flow may be precisely controlled. Benefits conferred to ICE performance include greater volumetric efficiency, reduced pumping losses, improved residual gas fraction (internal exhaust gas recirculation) control, and improved scavenging control (e.g., for turbocharged ICEs).

Similar to VVT, variable camshaft timing (VCT) may be implemented to achieve many of the above listed benefits. VCT may utilize camshaft phasers actuated via a high-pressure engine oil flow, which may advance or retard a camshaft from an initial position relative to a crankshaft position. As such, the camshaft may be dynamically tuned during ICE operation for desired (e.g., application-specific) performance.

Specifically, upon receipt of a pulse-width modulation signal from a powertrain control module (PCM), electronically-actuated oil control valves (OCVs) may direct the high-pressure engine oil flow into a desired camshaft phaser cavity to achieve a target camshaft position, whereat mild leakage and drainage may continually recirculate the engine oil while maintaining a high pressure thereof. When no camshaft phasing is requested by the PCM, a spring-loaded locking pin may fittingly engage a locking pocket such that relative motion between inner and outer rotors of a VCT phaser may be prevented. To subsequently transition to camshaft phasing, a minimum engine oil pressure may be applied to overcome the spring of the locking pin and thereby disengage the locking pin and lubricate contact points thereof.

During some engine speed transients (e.g., brief periods of negative acceleration following engine cold starts), the VCT phaser may be subjected to significant noise, vibration, and harshness (NVH) issues as a result of the locking pin failing to properly engage the locking pocket when the camshaft phaser cavities are substantially devoid of engine oil. In some examples, the locking pin, being partially or completely disengaged, may repeatedly slide along edges of the locking pocket, inducing premature mechanical wear. Without the minimum oil pressure facilitating desired motion of the locking pin into the locking pocket, cycles of mechanical wear may result in steadily increased rattling of the locking pin over time (which may further accelerate degradation of the locking pin and a corresponding locking mechanism).

Other attempts at reducing such mechanical wear have focused on actively increasing an engine oil pressure such that lubrication may be induced. One example approach is shown by Santoso et al. in U.S. Pat. No. 7,561,957. Another example approach is shown by Otterspeer et al. in U.S. Pat. No. 9,031,726. In both Santoso et al. and Otterspeer et al., adjustments are made to engine startup operations such that the engine oil pressure may be increased (e.g., to a minimum engine oil pressure threshold). For example, Otterspeer et al. teaches employing engine cranking to build up the engine oil pressure.

However, the inventors herein have recognized potential issues with such systems. As one example, a less than desirable ICE performance may result from greater than typical cranking duration (e.g., to increase the engine oil pressure) when starter battery, engine, and/or other vehicle conditions are not suited therefor. For instance, dynamic control of a minimum engine oil pressure threshold may be difficult to achieve absent knowledge of current conditions of the engine oil (e.g., an engine oil volumetric flow rate, an engine oil volume in the camshaft phaser cavities, etc.). As another example, addressing engine speed transients during engine cold starts principally responsible for locking pin degradation may depend on current conditions of the engine and/or the ambient environment. Without accounting for such current conditions, components of the ICE may be subjected to excessive mechanical wear, the cranking duration may be extended longer than desired, and maximal fuel efficiency may not be achieved.

In one example, the issues described above may be addressed by a method, including, responsive to one or more engine cold start conditions: initiating engine cranking; estimating an engine oil volume in a plurality of camshaft phaser cavities; and extending engine cranking based on the engine oil volume and the one or more engine cold start conditions. In this way, NVH issues during engine cold starts ascribed to increased mechanical wear of VCT phaser components (such as the locking pin) may be mitigated while optimizing fuel efficiency, e.g., by dynamically extending engine cranking based on select conditions.

As one example, a determination of an engine cranking duration may be made based on one or more starter battery conditions and/or one or more engine cold start conditions. For instance, each of a battery state of charge and a battery current capacity may be determined above respective thresholds prior to extending the engine cranking duration beyond a typical duration. Further, since a warmed up engine (e.g., following a transient engine stop/start event) may quickly build up an engine oil pressure, extending the engine cranking duration beyond the typical duration may be limited to engine cold start events. For example, the engine cranking duration may be extended upon an engine soak time being greater than a threshold soak time and/or one or more temperatures (e.g., of engine oil, engine coolant, and/or an ambient environment) less than respective threshold temperature(s).

Further, in some examples, because at least some engine oil may already be present in the plurality of camshaft phaser cavities upon engine startup (and thus at least some engine oil pressure may already be applied thereto), the cranking duration may be extended until a difference between a current engine oil pressure and a threshold engine oil pressure is accounted for. However, in other examples, engine cranking may not be overextended under an assumption that the engine oil pressure difference is substantially zero and engine fueling may be initiated as soon as possible (e.g., following engine cranking) while still mitigating the NVH issues associated with low engine oil pressure in the plurality of camshaft phaser cavities. In other examples, though the engine oil pressure may increase as a result of extending the engine cranking duration, the threshold engine oil pressure may not be reached prior to receipt of a fueling request. Accordingly, to prevent undesirable delays in fueling, extension of the engine cranking duration may be limited to a maximum extended cranking duration determined based on the one or more engine cold start conditions. In this way, fuel efficiency and NVH considerations may be balanced to improve an overall engine performance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to methods and systems for adjusting engine cranking to increase engine oil pressure (e.g., to increase engine oil flow to oil-actuated camshaft phaser cavities) in an engine including a variable cylinder valve system, such as the variable camshaft timing (VCT) system of FIGS. 1-3B. A control routine may be implemented at a controller communicably coupled to the engine and configured to adjust one or more engine operating conditions to adjust engine cranking. For example, the control routine may be the method depicted at FIG. 4 for extending engine cranking during an engine cold start event. Prophetic examples for adjusting engine cranking via various starter devices are shown at FIG. 5. FIGS. 6-9 depict exemplary engine cranking adjustments during exemplary startup events of engines including various respective starter devices.

Figure 1:
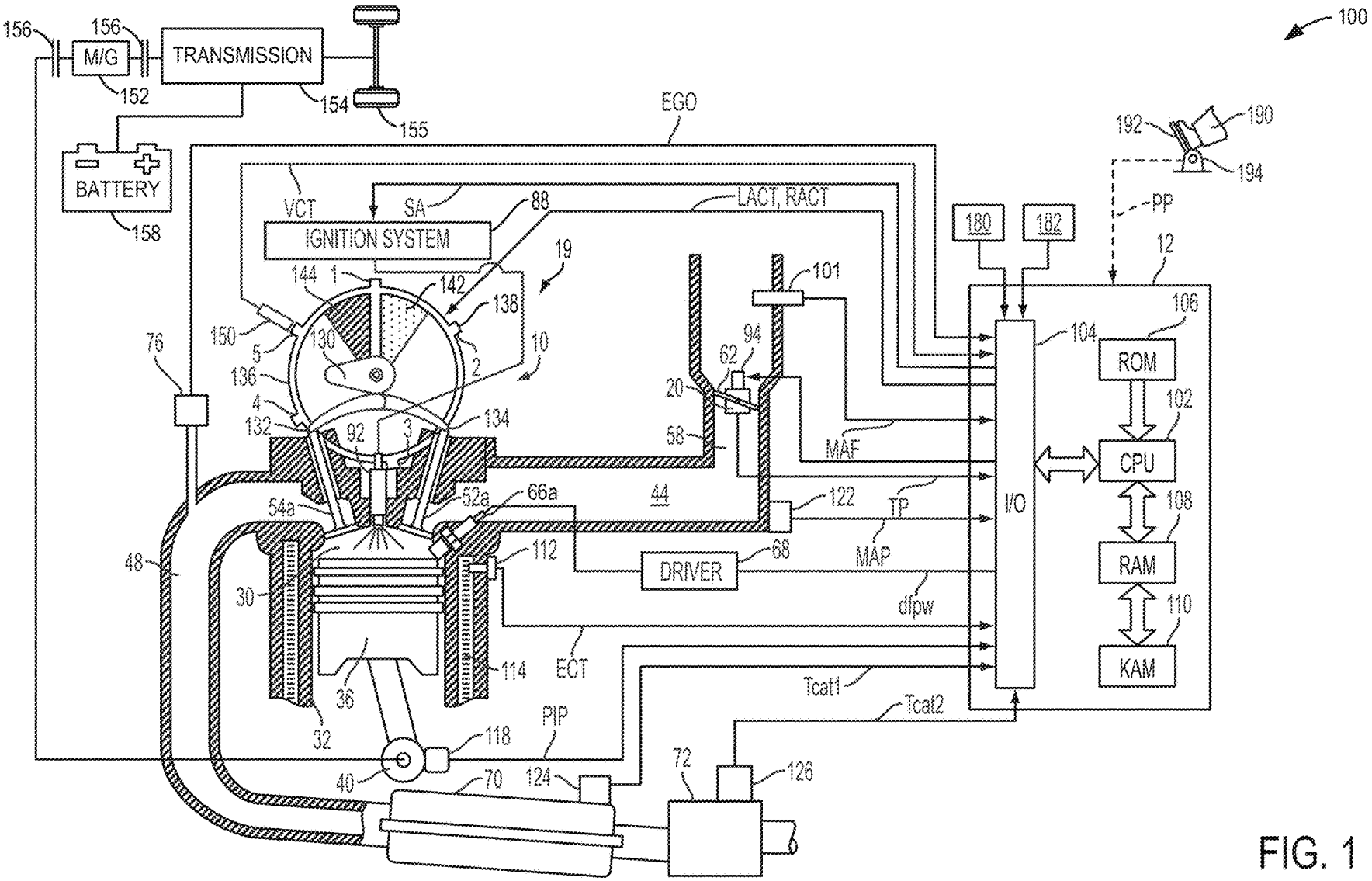
FIG. 1 shows a schematic diagram of an example cylinder of a multi-cylinder engine with an exemplary variable camshaft timing (VCT) phaser.

FIG. 1 depicts a schematic diagram 100 of an example embodiment of a combustion chamber or cylinder 30 of internal combustion engine 10. FIG. 1 shows that engine 10 may receive control parameters from a control system including controller 12, such as a powertrain control module (PCM), as well as input from a vehicle operator 190 via an input device 192. In this example, input device 192 includes an accelerator pedal and a pedal position sensor 194 for generating a proportional pedal position signal PP.

Cylinder (herein also "combustion chamber") 30 of engine 10 may include combustion chamber walls 32 with a piston 36 positioned therein. Piston 36 may be coupled to a crankshaft 40 so that reciprocating motion of the piston is translated into rotational motion of the crankshaft. Crankshaft 40 may be coupled to at least one drive wheel (e.g., 155) of a vehicle including the engine 10 via a transmission system (e.g., transmission 154). Further, a starter motor (e.g., motor 152) may be coupled to crankshaft 40 via a flywheel (not shown) to enable a starting operation of engine 10. Crankshaft 40 may be coupled to an oil pump 208 (FIG. 2) to pressurize an engine oil lubrication system 201 (the coupling of crankshaft 40 to oil pump 208 is not shown). A housing 136 may be hydraulically coupled to crankshaft 40 via a timing chain or belt (not shown).

Cylinder 30 may receive intake air via intake manifold or intake air passages 44. The intake air passages 44 may communicate with other cylinders of engine 10 in addition to cylinder 30. In some embodiments, one or more of the intake air passages 44 may include a boosting device such as a turbocharger or a supercharger (not shown). A throttle system including a throttle plate 62 may be provided along an intake passage 58 of engine 10 for varying a flow rate and/or pressure of intake air provided to the engine cylinders (e.g., cylinder 30). In this particular example, throttle plate 62 is coupled to an electric motor 94 so that the position of elliptical throttle plate 62 is controlled by controller 12 via electric motor 94. This configuration may be referred to as electronic throttle control (ETC), which may also be utilized during idle speed control.

Combustion chamber 30 is shown communicating with intake manifold 44 and an exhaust manifold 48 via respective intake valves (e.g., intake valve 52*a*), and exhaust valves (e.g., exhaust valve 54*a*). While in one example, four valves per cylinder may be used, in another example, a single intake valve and single exhaust valve per cylinder may also be used. In still another example, two intake valves and one exhaust valve per cylinder may be used.

Exhaust manifold 48 may receive exhaust gases from other cylinders of engine 10 in addition to cylinder 30. An exhaust gas sensor 76 is shown coupled to exhaust manifold 48 upstream of a catalytic converter 70, where the sensor may correspond to various different sensors. For example, sensor 76 may be any of many known sensors for providing an indication of exhaust gas air/fuel ratio such as a linear oxygen sensor, an exhaust gas oxygen (EGO) sensor, a universal or wide-range EGO (UEGO) sensor, a two-state oxygen sensor, a heated EGO (HEGO) sensor, or a hydrocarbon (HC) or carbon monoxide (CO) sensor. An emission control device 72 is shown positioned downstream of catalytic converter 70. Emission control device 72 may be a three-way catalyst (TWC), a nitrogen oxide (NOx) trap, various other emission control devices, or combinations thereof.

In some embodiments, each cylinder of engine 10 may include a spark plug 92 for initiating combustion. Ignition system 88 may provide an ignition spark to combustion chamber 30 via spark plug 92 in response to spark advance signal SA from controller 12, under select operating modes. However, in some embodiments, spark plug 92 may be omitted, such as where engine 10 may initiate combustion by auto-ignition or by injection of fuel, as may be the case with some diesel engines, for example.

In some embodiments, each cylinder of engine 10 may be configured with one or more fuel injectors for providing fuel thereto. As a non-limiting example, a fuel injector 66*a* is shown coupled directly to cylinder 30 for injecting fuel directly therein in proportion to the pulse width of a signal dfpw received from controller 12 via an electronic driver 68. In this manner, fuel injector 66*a* provides what is known as direct injection (hereafter also referred to as "DI") of fuel into cylinder 30. Fuel injector 66*a* may be mounted in the side of combustion chamber 30 (as shown) or in the top of the combustion chamber (near the spark plug), for example. Fuel may be delivered to fuel injector 66*a* by a fuel system including a fuel tank, a fuel pump, and a fuel rail (not shown). In some embodiments, combustion chamber 30 may alternatively or additionally include a fuel injector arranged in intake manifold 44 in a configuration that provides what is known as port injection of fuel into an intake port upstream of combustion chamber 30.

Controller 12 is shown as a microcomputer, including a microprocessor unit 102, input/output ports 104, an electronic storage medium for executable programs and calibration values shown as a non-transitory read-only memory chip 106 in this particular example, random access memory 108, keep alive memory 110, and a conventional data bus. Controller 12 is shown receiving various signals from sensors coupled to engine 10, in addition to those signals previously discussed, including measurement of an inducted mass air flow (MAF) from a MAF sensor 101 coupled to throttle plate 62, an engine coolant temperature (ECT) from a temperature sensor 112 coupled to a cooling sleeve 114, a profile ignition pickup signal PIP from a Hall effect sensor 118 coupled to crankshaft 40, a throttle position TP from a throttle position sensor 20, an absolute manifold pressure signal MAP from a sensor 122, an indication of knock from a knock sensor 182, and an indication of an absolute or relative ambient humidity from a sensor 180. An engine speed signal RPM is generated by controller 12 from signal PIP in a conventional manner and manifold pressure signal MAP from a manifold pressure sensor (e.g., sensor 122) provides an indication of vacuum, or pressure, in intake manifold 44. During stoichiometric operation, this sensor may give an indication of engine load. Further, signals from this sensor, along with an indication of engine speed, may enable estimation of charge (including air) inducted into the cylinder 30. In one example, sensor 118, which is also used as an engine speed sensor, produces a predetermined number of equally spaced pulses every revolution of crankshaft 40.

In this particular example, a temperature Tcat1 of catalytic converter 70 is provided by a temperature sensor 124 and a temperature Tcat2 of emission control device 72 is provided by a temperature sensor 126. In an alternate embodiment, temperature Tcat1 and temperature Tcat2 may be inferred from engine operation.

Continuing with FIG. 1, a variable camshaft timing (VCT) system 19 is shown. In this example, an overhead cam system is illustrated, although other approaches may be used. Specifically, a camshaft 130 of engine 10 is shown communicating with rocker arms 132 and 134 for actuating intake valves (e.g., 52*a*) and exhaust valves (e.g., 54*a*). In the depicted example, and in the example of FIG. 3A described in further detail below, VCT system 19 is cam-torque actuated (CTA), wherein actuation of a camshaft phaser of the VCT system is enabled via cam torque pulses. In additional or alternative examples, such as in the example of FIG. 3B described in further detail below, VCT system 19 may be oil-pressure actuated (OPA). By adjusting a plurality of hydraulic control valves to thereby direct a hydraulic fluid, such as engine oil, into the cavity (such as an advance chamber or a retard chamber) of a camshaft phaser, valve timing may be changed (e.g., advanced or retarded). As further elaborated herein, the operation of the hydraulic control valves may be controlled by respective control solenoids. Specifically, controller 12 may transmit a signal to the control solenoids to move a spool valve that regulates a flow of oil through the phaser cavity. As used herein, advance and retard of cam timing refer to relative cam timings, in that a fully advanced position may still provide a retarded intake valve opening with regard to top dead center, as just an example.

Camshaft 130 may be hydraulically coupled to housing 136. Housing 136 forms a toothed wheel having a plurality of teeth 138. In the example embodiment, housing 136 is mechanically coupled to crankshaft 40 via a timing chain or belt (not shown). Therefore, housing 136 and camshaft 130 rotate at a speed substantially equivalent to each other and synchronous to the crankshaft. In an alternate embodiment, as in a four stroke engine, for example, housing 136 and crankshaft 40 may be mechanically coupled to camshaft 130 such that housing 136 and crankshaft 40 may synchronously rotate at a speed different than camshaft 130 (e.g., at a 2:1 ratio, where the crankshaft rotates at twice the speed of the camshaft). In the alternate embodiment, teeth 138 may be mechanically coupled to camshaft 130. By manipulation of the hydraulic coupling as described herein, the relative position of camshaft 130 to crankshaft 40 may be varied by hydraulic pressures in a retard chamber 142 and an advance chamber 144. By allowing high-pressure hydraulic fluid to enter retard chamber 142, the relative relationship between camshaft 130 and crankshaft 40 may be retarded. Thus, intake valves (e.g., 52*a*) and exhaust valves (e.g., 54*a*) may open and close at a time later than normal relative to crankshaft 40. Similarly, by allowing high-pressure hydraulic fluid to enter advance chamber 144, the relative relationship between camshaft 130 and crankshaft 40 may be advanced. Thus, intake valves (e.g., 52*a*) and exhaust valves (e.g., 54*a*) may open and close at a time earlier than normal relative to crankshaft 40.

While this example shows a system in which intake and exhaust valve timing are controlled concurrently, variable intake cam timing, variable exhaust cam timing, dual independent variable cam timing, dual equal variable cam timing, or other variable cam timing may be used. Further, variable valve lift may also be used. Further, camshaft profile switching may be used to provide different cam profiles under different operating conditions. Further still, a valvetrain may be roller finger follower, direct acting mechanical bucket, electrohydraulic, or other alternatives to rocker arms 132, 134.

Continuing with VCT system 19, teeth 138, rotating synchronously with camshaft 130, may allow for measurement of relative cam position via a cam timing sensor 150 providing a signal VCT to controller 12. Teeth 1, 2, 3, and 4 may be used for measurement of cam timing and may be equally spaced (for example, in a V-8 dual bank engine, spaced 90 degrees apart from one another), while tooth 5 may be used for cylinder identification. In addition, controller 12 may send control signals LACT, RACT to conventional solenoid valves (not shown) to control the flow of (high-pressure) hydraulic fluid either into retard chamber 142, advance chamber 144, or neither.

Relative cam timing may be measured in a variety of ways. In general terms, the time, or rotation angle, between a rising edge of the PIP signal and receiving a signal from one of the teeth 138 on housing 136 gives a measure of the relative cam timing. For the particular example of a V-8 engine, with two cylinder banks and a five-toothed wheel, a measure of cam timing for a particular bank is received four times per revolution, with an extra signal being used for cylinder identification.

As described above, FIG. 1 merely shows one cylinder of a multi-cylinder engine, where each cylinder may have its own set of intake/exhaust valves, fuel injectors, spark plugs, etc. It will be appreciated that engine 10 may include any suitable number of cylinders, including 2, 3, 4, 5, 6, 8, 10, 12, or more cylinders. Further, each of these cylinders may include some or all of the various components described and depicted by FIG. 1 with reference to cylinder 30.

In some examples, engine 10 may be implemented in a hybrid vehicle with multiple sources of torque available to one or more vehicle wheels 155. In other examples, engine 10 may be implemented in a conventional vehicle with no additional sources of torque. In the example shown, engine 10 is coupled to an electric machine 152. Electric machine 152 may be a motor or a motor/generator. In some embodiments, electric machine 152 may be a starter device, such as a starter motor (SM), a 12V or 48V P1/P2 integrated starter generator (ISG) motor [also referred to as a crank ISG (CISG)], or a 12V or 48V belt ISG (BISG). It will be appreciated that such embodiments are exemplary, and that a voltage level of the starter device is not particularly limited to such configurations. Crankshaft 40 of engine 10 and electric machine 152 may be connected via transmission 154 to vehicle wheels 155 when one or more clutches 156 are engaged. In the depicted example, a first clutch 156 is provided between crankshaft 40 and electric machine 152, and a second clutch 156 is provided between electric machine 152 and transmission 154. Controller 12 may send a signal to an actuator of each clutch 156 to engage or disengage the clutch, so as to connect or disconnect crankshaft 40 from electric machine 152 and the components connected thereto, and/or connect or disconnect electric machine 152 from transmission 154 and the components connected thereto. Transmission 154 may be a gearbox, a planetary gear system, or another type of transmission. The powertrain may be configured in various manners including as a parallel, a series, or a series-parallel hybrid.

Electric machine 152 may receive electrical power from a traction battery 158 to provide torque to vehicle wheels 155. Electric machine 152 may also be operated as a generator to provide electrical power to charge battery 158, for example during a braking operation.

Figure 2:
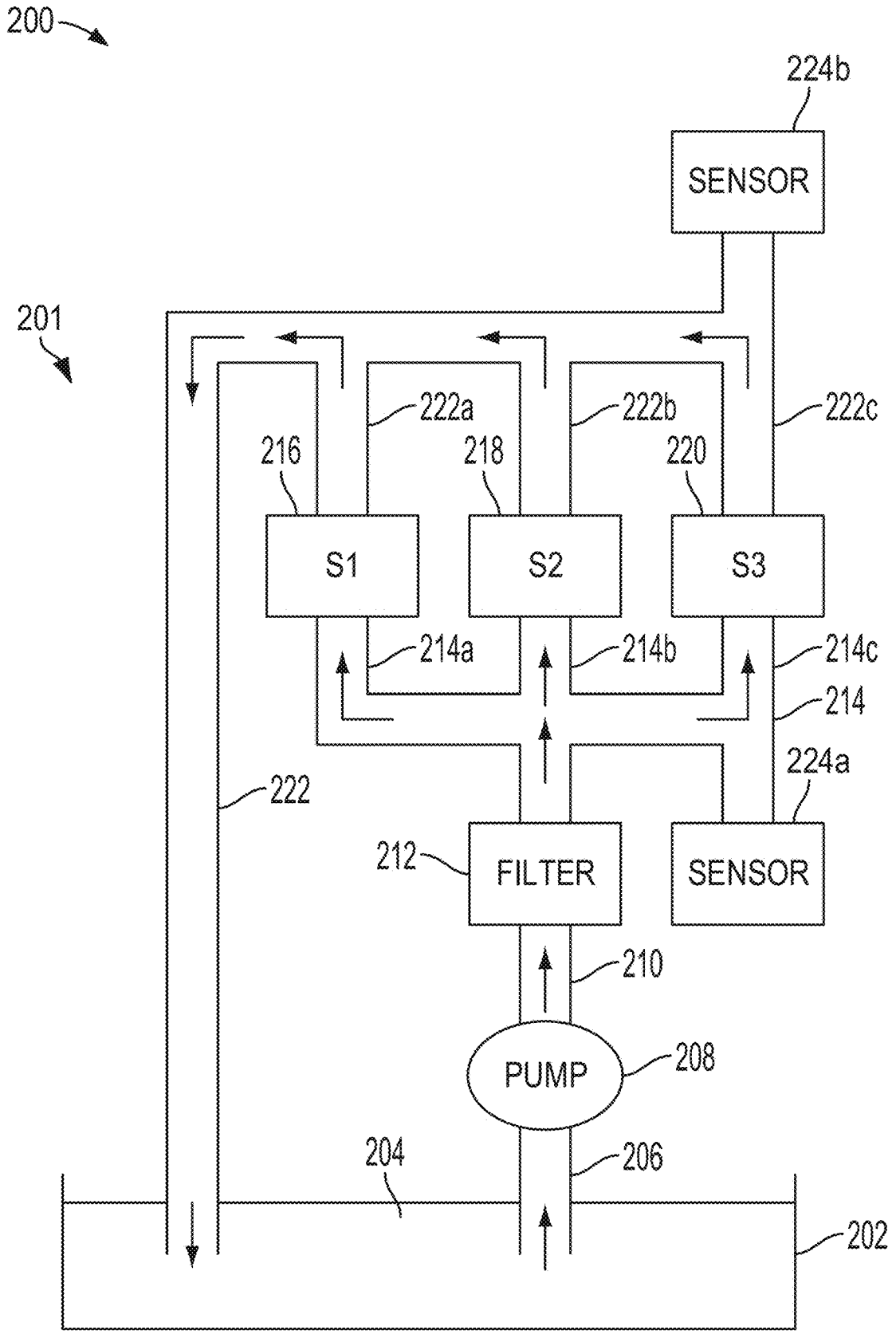
FIG. 2 shows a block diagram of an exemplary engine oil lubrication system, for use with the multi-cylinder engine of FIG. 1, for example.

FIG. 2 shows a block diagram 200 of an example embodiment of an engine oil lubrication system 201 with an oil pump 208 coupled to crankshaft 40 (see FIG. 1; coupling not shown), and including various oil subsystems 216, 218, 220 (S1, S2, S3, respectively). A given oil subsystem 216, 218, 220 may utilize engine oil flow to perform some function, such as lubrication, actuation of an actuator, etc. For example, one or more of oil subsystems 216, 218, 220 may be hydraulic systems with hydraulic actuators and hydraulic control valves. Further, oil subsystems 216, 218, 220 may be lubrication systems, such as passageways for delivering engine oil to moving components, such as the camshafts, cylinder valves, etc. Still further non-limiting examples of oil subsystems are camshaft phasers, cylinder walls, miscellaneous bearings, etc. Engine oil may be supplied to oil subsystems 216, 218, 220 through a supply channel and engine oil may be returned through a return channel. In some embodiments, there may be fewer or more oil subsystems. In one embodiment, at least one oil subsystem (e.g., 216, 218, and/or 220) lubricates and/or actuates components of a VCT phaser system, such as VCT phaser 350 of FIGS. 3A and 3B (as described in further detail below).

Specifically, oil pump 208, in association with rotation of crankshaft 40 (FIG. 1), may suck or siphon engine oil from an oil reservoir 204, stored in an oil pan 202, through a supply channel 206. Engine oil may be delivered from oil pump 208 with pressure through a supply channel 210 and an oil filter 212 to a main galley 214. The pressure within the main galley 214 may be a function of a force produced by oil pump 208 and the flow of engine oil entering each oil subsystem 216, 218, 220 through supply channels 214*a*, 214*b*, 214*c*, respectively. Engine oil may return to oil reservoir 204 at atmospheric pressure through a return channel 222 from oil subsystems 216, 218, 220 via respective return channels 222*a*, 222*b*, 222*c*. Oil pump 208 may be an engine driven pump, a pump output being higher at higher engine speeds and lower at lower engine speeds.

A sensor 224*a* and/or a sensor 224*b* may be provided in engine oil lubrication system 200 to measure absolute or relative engine oil pressure and/or engine oil volumetric flow rate. As an example, sensor 224*a* may measure the main galley oil pressure and may send signals indicative of the pressure to controller 12 (FIG. 1). As another example, each of sensor 224*a* and sensor 224*b* may measure an engine oil pressure difference along an engine oil flow path (e.g., along channel 222*c* and across oil subsystem 220) and may send signals indicative of the pressure difference to controller 12 (FIG. 1).

An oil pressure level may affect performance of one or more of oil subsystems 216, 218, 220, for example, a force generated by a hydraulic actuator may be directly proportional to the main galley oil pressure. When the main galley oil pressure is high, the actuator may be more responsive; when the main galley oil pressure is low, the actuator may be less responsive. Low oil pressure may also limit an effectiveness of engine oil to lubricate moving components. For example, if the main galley oil pressure is below a threshold pressure, a reduced flow of lubricating oil may be delivered, and component degradation may occur. Additionally, the main galley oil pressure may be highest when there is no, or reduced, flow of engine oil out of main galley 214. For example, leakage of hydraulic actuators in oil subsystems 216, 218, 220 may reduce the main galley oil pressure.

Figure 3A:
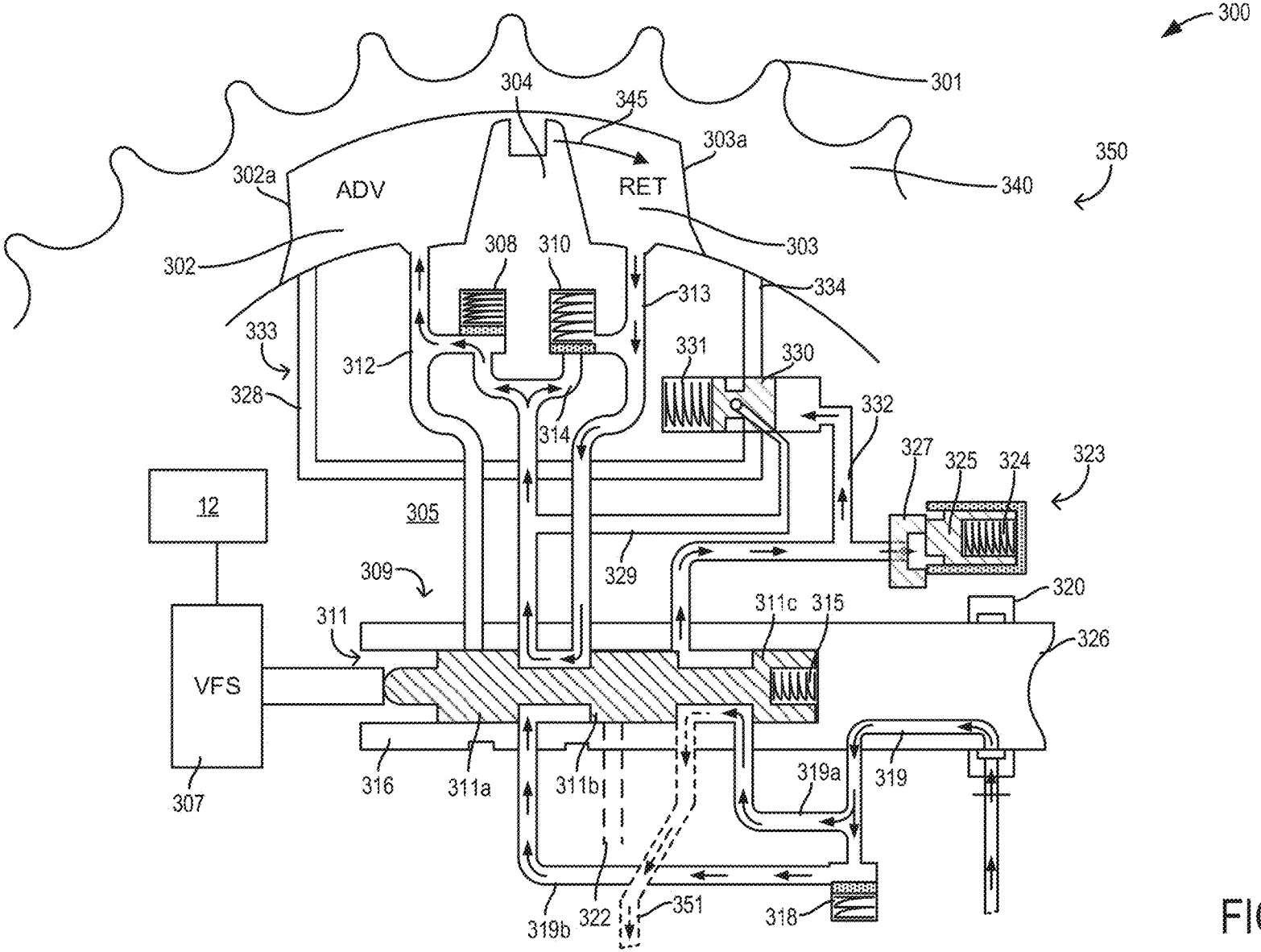
FIGS. 3A and 3B show schematic diagrams of an exemplary VCT phaser, for use with the multi-cylinder engine of FIG. 1 and the exemplary engine oil lubrication system of FIG. 2, for example.

FIG. 3A shows a schematic diagram 300 of an example embodiment of a VCT phaser 350 in an advanced position. In one example, VCT phaser 350 may be included in VCT system 19 of FIG. 1. FIG. 3A further depicts a solenoid-operated spool valve 309 coupled to VCT phaser 350. Spool valve 309 is shown positioned in an advance region of a spool 311 as a non-limiting example. It will be appreciated that spool valve 309 may have an effectively infinite number of intermediate positions, such as positions in the advance region, a null region, or a detent region of spool 311 (as elaborated below). The position of spool valve 309 may control a direction of VCT phaser motion and, depending on the discrete spool position, may also control a rate of VCT phaser motion.

Internal combustion engines have employed various mechanisms to vary the angle between the camshaft and the crankshaft for improved engine performance or reduced emissions. The majority of such (VCT) mechanisms use one or more "vane phasers" on the camshaft (or camshafts, in a multiple-camshaft engine), such as VCT phaser 350. VCT phaser 350 may include a rotor or rotor assembly 305 with one or more vanes 304, mounted to an end of a camshaft 326, surrounded by a housing assembly 340 with vane chambers into which vanes 304 respectively fit. In an alternate example, vanes 304 may be mounted to housing assembly 340, and the vane chambers may be mounted in rotor assembly 305. An outer circumference 301 of housing assembly 340 may form a sprocket, pulley, or gear accepting drive force through a chain, belt, or gears, usually from the crankshaft (e.g., 40), or from another camshaft in a multiple-cam engine.

VCT phaser 350 is depicted in FIG. 3A as including CTA components. Therein, torque reversals in camshaft 326, caused by the forces of opening and closing engine valves, may move a given vane 304. Advance and retard chambers 302, 303 may be arranged to resist positive and negative torque pulses in camshaft 326 and may be alternately pressurized by the cam torque. As shown, a main supply line 319 may enter VCT phaser 350 via bearing 320, whereafter main supply line 319 may bifurcate into supply lines 319*a*, 319*b* (e.g., actuated by spring 318) such that fluid (e.g., engine oil) may be supplied to VCT phaser 350. Spool valve 309 may allow vane 304 in VCT phaser 350 to move by permitting fluid flow from advance chamber 302 to retard chamber 303 or vice versa, depending on a desired direction of movement. For example, when the desired direction of movement is in the advance direction, spool valve 309 may allow the vane 304 to move by permitting fluid flow from retard chamber 303 to advance chamber 302 (e.g., actuated by a spring 308). In comparison, when the desired direction of movement is in the retard direction, spool valve 309 may allow vane 304 to move by permitting fluid flow from advance chamber 302 to retard chamber 303 (e.g., actuated by a spring 310).

Outer circumference 301 of housing assembly 340 may accept drive force. In the depicted embodiment, rotor assembly 305 is coupled to camshaft 326 and coaxially located within housing assembly 340. As described above, rotor assembly 305 may include at least one vane 304, where vane 304 may separate a chamber formed between housing assembly 340 and rotor assembly 305 into advance chamber 302 and retard chamber 303. Vane 304 may be capable of rotation to shift a relative angular position of housing assembly 340 and rotor assembly 305.

Additionally, a hydraulic detent circuit 333 and a locking pin circuit 323 are also present. Hydraulic detent circuit 333 and locking pin circuit 323 may be fluidly coupled, making them effectively one circuit, but will be discussed separately for simplicity and for better distinguishing their distinct functions. Hydraulic detent circuit 333 may include a spring 331 loaded piloted valve 330, an advance detent line 328 that connects advance chamber 302 to piloted valve 330 and a common line 314, and a retard detent line 334 that connects retard chamber 303 to piloted valve 330 and common line 314. Advance detent line 328 and retard detent line 334 may be a predetermined distance or length from vane 304. Piloted valve 330 may be in rotor assembly 305 and may be fluidly coupled to locking pin circuit 323 and supply line 319*a* through a connecting line 332. Locking pin circuit 323 may include a locking pin 325, connecting line 332, piloted valve 330, supply line 319*a*, and an exhaust line 322 (long dashed lines).

Piloted valve 330 may be actuated between two positions: a first position which may correspond to a closed or "off" position, and a second position which may correspond to an open or "on" position. Piloted valve 330 may be commanded to these positions by spool valve 309. In the first position, piloted valve 330 may be pressurized by engine generated oil pressure in connecting line 332, which may position piloted valve 330 such that fluid may be blocked from flowing between advance and retard chambers 302, 303 through piloted valve 330 and hydraulic detent circuit 333. In the second position, engine generated oil pressure in connecting line 332 may be absent. The absence of pressure in connecting line 332 may enable spring 331 to position piloted valve 330 so that fluid may be allowed to flow between advance detent line 328 from advance chamber 302 and retard detent line 334 from retard chamber 303 through piloted valve 330 and a common line, such that rotor assembly 305 may be moved to and held in a locking position.

Locking pin 325 may be slidably housed in a bore in rotor assembly 305 and may have an end portion biased towards and fittable into a recess 327 in housing assembly 340 by a spring 324. Alternatively, locking pin 325 may be housed in housing assembly 340 and may be spring 324 biased towards recess 327 in rotor assembly 305. When locking pin 325 is engaged with (e.g., fitted into) recess 327, locking pin circuit 323 may restrict movement of rotor assembly 305 such that overall movement of VCT phaser 350 may be correspondingly restricted. When locking pin 325 is not engaged with (e.g., free from) recess 327, locking pin circuit 323 may allow movement of rotor assembly 305 such that overall movement of VCT phaser 350 may be correspondingly allowed.

The opening and closing of hydraulic detent circuit 333 and pressurization of locking pin circuit 323 may both be controlled by the switching/movement of spool valve 309. Spool valve 309 may include spool 311 with cylindrical spool lands 311*a*, 311*b*, 311*c* slidably received in a sleeve 316 within a bore in rotor assembly 305 and pilots in camshaft 326. One end of spool 311 may contact spring 315 and an opposite end of spool 311 may contact a pulse-width modulated variable force solenoid (NTS) 307. Solenoid 307 may also be linearly controlled by varying duty cycle, current, voltage, or other methods as applicable. Additionally, the opposite end of spool 311 may contact and be influenced by a motor or other actuators.

The position of spool 311 may be influenced by spring 315 and solenoid 307 controlled by the controller 12. Further detail regarding control of VCT phaser 350 is discussed below. The position of spool 311 may control the motion of VCT phaser 350, including a direction of motion as well as a rate of motion. For example, the position of spool 311 may determine whether to move VCT phaser 350 towards the advance position, towards a holding position (e.g., in between the advance and retard positions), or towards the retard position. In addition, the position of spool 311 may determine whether locking pin circuit 323 and hydraulic detent circuit 333 are open (on) or closed (off). In this way, the position of spool 311 may actively control piloted valve 330. Spool valve 309 may have an advance mode, a retard mode, a null mode, and a detent mode. These modes of control may be directly associated with regions of positioning. Thus, particular regions of a stroke of spool valve 309 may allow the spool valve to operate in the advance, retard, null, and detent modes. In the advance mode, spool 311 may be moved to a position in the advance region of spool valve 309, thereby enabling fluid to flow from retard chamber 303 through spool 311 on to advance chamber 302, while fluid is blocked from exiting advance chamber 302. In addition, hydraulic detent circuit 333 may be held off or closed. In the retard mode, spool 311 may be moved to a position in the retard region of spool valve 309, thereby enabling fluid to flow from advance chamber 302 through spool 311 on to retard chamber 303, while fluid may be blocked from exiting retard chamber 303. In addition, hydraulic detent circuit 333 may be held off or closed. In the null mode, spool 311 may be moved to a position in a null region of spool valve 309, thereby blocking the exit of fluid from each of advance and retard chambers 302, 303, while continuing to hold hydraulic detent circuit 333 off or closed. In the detent mode, spool 311 may be moved to a position in a detent region. In the detent mode, three functions may occur simultaneously. The first function in the detent mode is that spool 311 may move to a position in which spool land 311*b* blocks the flow of fluid from a line 312 in between spool lands 311*a* and 311*b* from entering any of the other lines and a line 313, effectively removing control of VCT phaser 350 from spool valve 309. The second function in detent mode is the opening or turn on of hydraulic detent circuit 333. As such, hydraulic detent circuit 333 hay have complete control over VCT phaser 350 moving to advance or retard positions, until vane 304 reaches an intermediate phase angle position. The third function in the detent mode is to vent locking pin circuit 323, allowing locking pin 325 to engage in recess 327. The intermediate phase angle position, herein also referred to as a mid-lock position and also as the locking position, may be defined as a position when vane 304 is between an advance wall 302*a* and a retard wall 303*a*, the walls defining the chamber (cavity) between housing assembly 340 and rotor assembly 305. The locking position may be a position anywhere between advance wall 302*a* and retard wall 303*a* and may be determined by positions of detent lines 328 and 334 relative to vane 304. Specifically, the positions of detent lines 328 and 334 relative to vane 304 may define a position wherein neither passage may be exposed to advance and retard chambers 302, 303, thus fully disabling communication between the two chambers when piloted valve 330 is in the second position and an overall phasing circuit is disabled. Commanding spool valve 309 to the detent region may also be referred to herein as commanding a "hard lock" or "hard locking" VCT phaser 350, in reference to the hardware component (locking pin) involved in locking the VCT phaser being engaged at the mid-lock position.

Based on the duty cycle of solenoid 307, spool 311 may move to a corresponding position along its stroke. In one example, when the duty cycle of the solenoid 307 is approximately 30%, 50%, or 100%, spool 311 may be moved to positions that correspond with the retard mode, the null mode, and the advance mode, respectively, and piloted valve 330 may be pressurized and moved from the second position to the first position, while hydraulic detent circuit 333 may be closed and locking pin 325 may be pressurized and released. As another example, when the duty cycle of the solenoid 307 is set to 0%, spool 311 may be moved to the detent mode such that piloted valve 330 may vent and move to the second position, while hydraulic detent circuit 333 may be opened and locking pin 325 may be vented and engaged with recess 327. By choosing the duty cycle of 0% as an extreme position along the spool stroke to open hydraulic detent circuit 333, vent piloted valve 330, and vent and engage locking pin 325 with recess 327, in the event that power or control is lost, VCT phaser 350 may default to a locked position, improving cam phaser position certainty. It should be noted that the duty cycle percentages listed above are provided as non-limiting examples, and in alternate embodiments, different duty cycles may be used to move spool 311 of spool valve 309 between the different spool regions. For example, hydraulic detent circuit 333 may alternatively be opened, piloted valve 330 vented, and locking pin 325 vented and engaged with recess 327 at 100% duty cycle. In this example, the detent region of spool valve 309 may be adjacent to the advance region instead of the retard region. In another example, the detent mode may be at a 0% duty cycle, and duty cycles of approximately 30%, 50%, and 100% may move spool 311 to positions that correspond with the advance mode, the null mode, and the retard mode, respectively. Likewise in this example, the advance region of spool valve 309 may be adjacent to the detent region.

During selected conditions, the controller 12 may map one or more regions of spool 311 by varying the duty cycle commanded to spool valve 309 and correlating it with corresponding changes in the position of VCT phaser 350. For example, a transitional region between the detent region and the retard region of spool 311, herein also referred to as the "no-fly zone," may be mapped by correlating motion of spool valve 309 out of the detent region into the retard region with motion of VCT phaser 350 from the mid-lock position towards the retard position. In alternate embodiments, when the detent region is adjacent to the advance region, the no-fly zone may be between the detent region and the advance region of spool 311.

FIG. 3A shows VCT phaser 350 moving towards the advance position. To move VCT phaser 350 towards the advance position, the duty cycle of spool valve 309 may be increased to greater than 50%, and optionally up to 100%. As a result, the force of solenoid 307 on spool 311 may be increased, and spool 311 may be moved to the right, towards the advance region and operated in the advance mode, until the force of spring 315 balances the force of solenoid 307. In the advance mode shown, spool land 311*a* blocks line 312 while line 313 and common line 314 are open. In this scenario, camshaft torque pulses may pressurize retard chamber 303, causing fluid to move from retard chamber 303 into advance chamber 302, thereby moving vane 304 in the direction shown by arrow 345. Hydraulic fluid may exit from retard chamber 303 through line 313 to spool valve 309, between spool lands 311*a* and 311*b*, and may recirculate back to common line 314 and line 312 leading to advance chamber 302. Piloted valve 330 may be held in the first position, blocking detent lines 328 and 334.

In an alternate example, to move VCT phaser 350 towards the retard position, the duty cycle of spool valve 309 may be decreased to lower than 50%, and optionally up to 30%. As a result, the force of solenoid 307 on spool 311 may be decreased, and spool 311 may be moved to the left, towards the retard region and operated in the retard mode, until the force of spring 315 balances the force of solenoid 307. In the retard mode, spool land 311*b* may block line 313 while line 312 and common line 314 are open. In this scenario, camshaft torque pulses may pressurize advance chamber 302, causing fluid to move from advance chamber 302 into retard chamber 303, and thereby moving vane 304 in the direction opposite to that shown by arrow 345. Hydraulic fluid may exit from advance chamber 302 through line 312 to spool valve 309, between spool lands 311*a* and 311*b*, and may recirculate back to common line 314 and line 313 leading to retard chamber 303. Piloted valve 330 may be held in the first position, blocking detent lines 328 and 334.

In a further example, to move VCT phaser 350 to, and lock in, the intermediate phase angle (or mid-lock) position, the duty cycle of spool valve 309 may be decreased to 0%. As a result, the force of solenoid 307 on spool 311 may be decreased, and spool 311 may be moved to the left, towards the detent region and operated in the detent mode, until the force of spring 315 balances the force of solenoid 307. In the detent mode, spool land 311*b* may block lines 312, 313 and common line 314, and spool land 311*c* may block supply line 319*a* from pressurizing line 332 to move piloted valve 330 to the second position. In this scenario, camshaft torque pulses do not provide actuation. Instead, hydraulic fluid may exit from advance chamber 302 through detent line 328 to piloted valve 330, through a common line 329, and may recirculate back to common line 314 and line 313 leading to retard chamber 303.

Embodiments of VCT phaser 350 may be exclusively CTA (aspects of which are described in detail with reference to FIG. 3A), exclusively OPA (aspects of which are described in detail with reference to FIG. 3B), or a combination thereof. In some embodiments, a connection line 351 (short dashed lines) may supply fluid to one or more additional vanes (e.g., vanes 364 of FIG. 3B) of rotor assembly 305. In an exemplary embodiment, the fluid may be engine oil and movement of the one or more additional vanes supplied therewith by connection line 351 may be OPA rather than CTA.

Figure 3B:
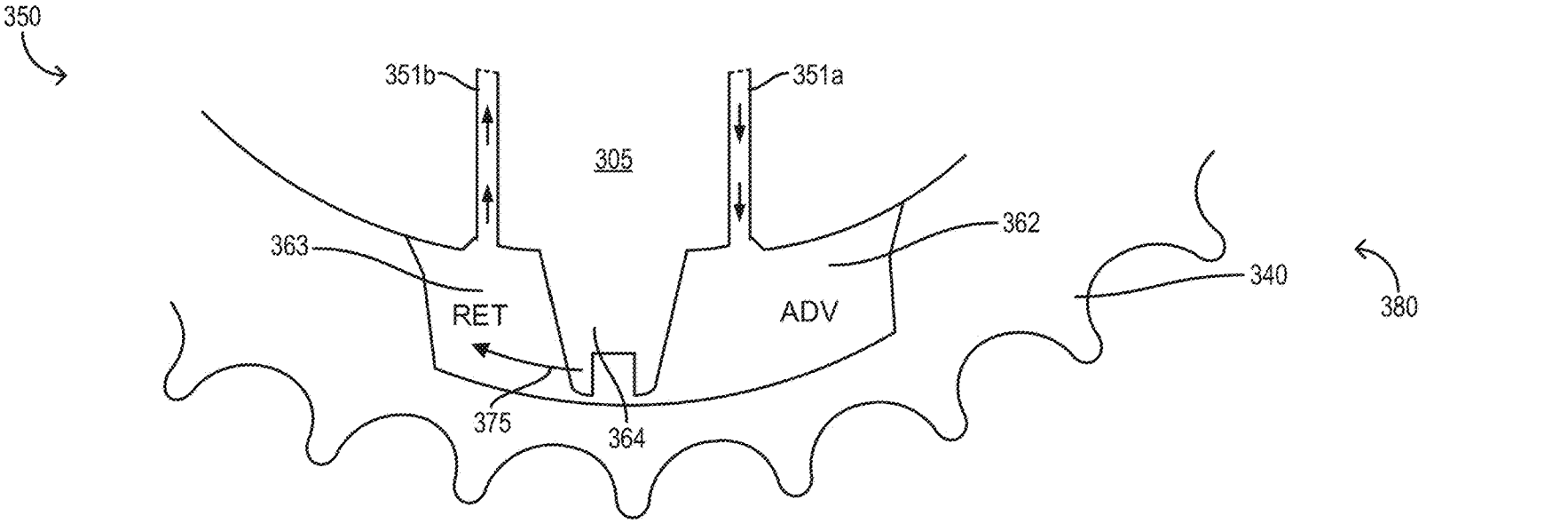

FIG. 3B shows a schematic diagram 360 of an example embodiment of an additional portion 380 of VCT phaser 350 in an advanced position. In one example, additional portion 380 of VCT phaser 350 may be coupled with each of the various components depicted in FIG. 3A. In another example, only select aspects described above with reference to FIG. 3A may be coupled to additional portion 380 of VCT phaser 350. For example, additional portion 380 of VCT phaser 350 may couple to one or more of the components of FIG. 3A via lines 351*a*, 351*b* such that spool valve 309, locking pin circuit 323, hydraulic detent circuit 333, etc. of FIG. 3A may be fluidly coupled to additional portion 380 of VCT phaser 350. Specifically, one or both of lines 351*a*, 351*b* may couple to connection line 351 of FIG. 3A.

As described in detail above with reference to FIG. 3A, additional portion 380 of VCT phaser 350 may include one or more additional vanes 364 of rotor assembly 305 surrounded by housing assembly 340 with vane chambers into which additional vanes 364 respectively fit. In an alternate example, additional vanes 364 may be mounted to housing assembly 340, and the vane chambers may be mounted in rotor assembly 305.

VCT phaser 350 is depicted in FIG. 3B as including OPA components. Therein, line 351*a* may supply engine oil to an advance chamber 362 (e.g., via direct fluid coupling to an engine oil lubrication system, such as engine oil lubrication system 200 of FIG. 2) responsive to a request to advance a position of VCT phaser 350. For example, spool land 311*c* of FIG. 3A may be positioned so as to allow engine oil to flow to line 351*a* from a supply line (e.g., supply line 319*a*). Accordingly, engine oil may build up pressure in advance chamber 362, thereby moving a given additional vane 364 in the direction shown by arrow 365. Moving additional vane 364 may simultaneously force engine oil present in a retard chamber 363 out via line 351*b*.

As an alternate example, line 351*b* may supply engine oil to retard chamber 363 (e.g., via direct fluid coupling to an engine oil lubrication system, such as engine oil lubrication system 200 of FIG. 2) responsive to a request to retard a position of VCT phaser 350. For example, spool land 311*c* of FIG. 3A may be positioned so as to allow engine oil to flow to line 351*b* from a supply line (e.g., supply line 319*a*). Accordingly, engine oil may build up pressure in retard chamber 363, thereby moving additional vane 364 in the direction opposite to that shown by arrow 365. Moving additional vane 364 may simultaneously force engine oil present in advance chamber 362 out via line 351*a*.

An engine controller (e.g., a PCM, such as controller 12) may receive signals from the various sensors of FIGS. 1-3B and then may notify a vehicle operator of potential issues and/or employ the various actuators of FIGS. 1-3B (e.g., the electric machine, the oil pump, the fuel injector, etc.) to adjust engine operation based on the received signals and instructions stored on a memory of the engine controller. In the example embodiment of FIG. 1, for instance, non-transitory read-only memory chip 106 may be programmed with non-transitory, computer readable data representing instructions executable by microprocessor unit 102 for performing the various diagnostic and control routines. As one example, an exemplary control routine for adjusting engine cranking to increase an engine oil pressure (e.g., in engine oil lubrication system 201 of FIG. 2) is provided by the method described in detail below with reference to FIG. 4.

Figure 4:
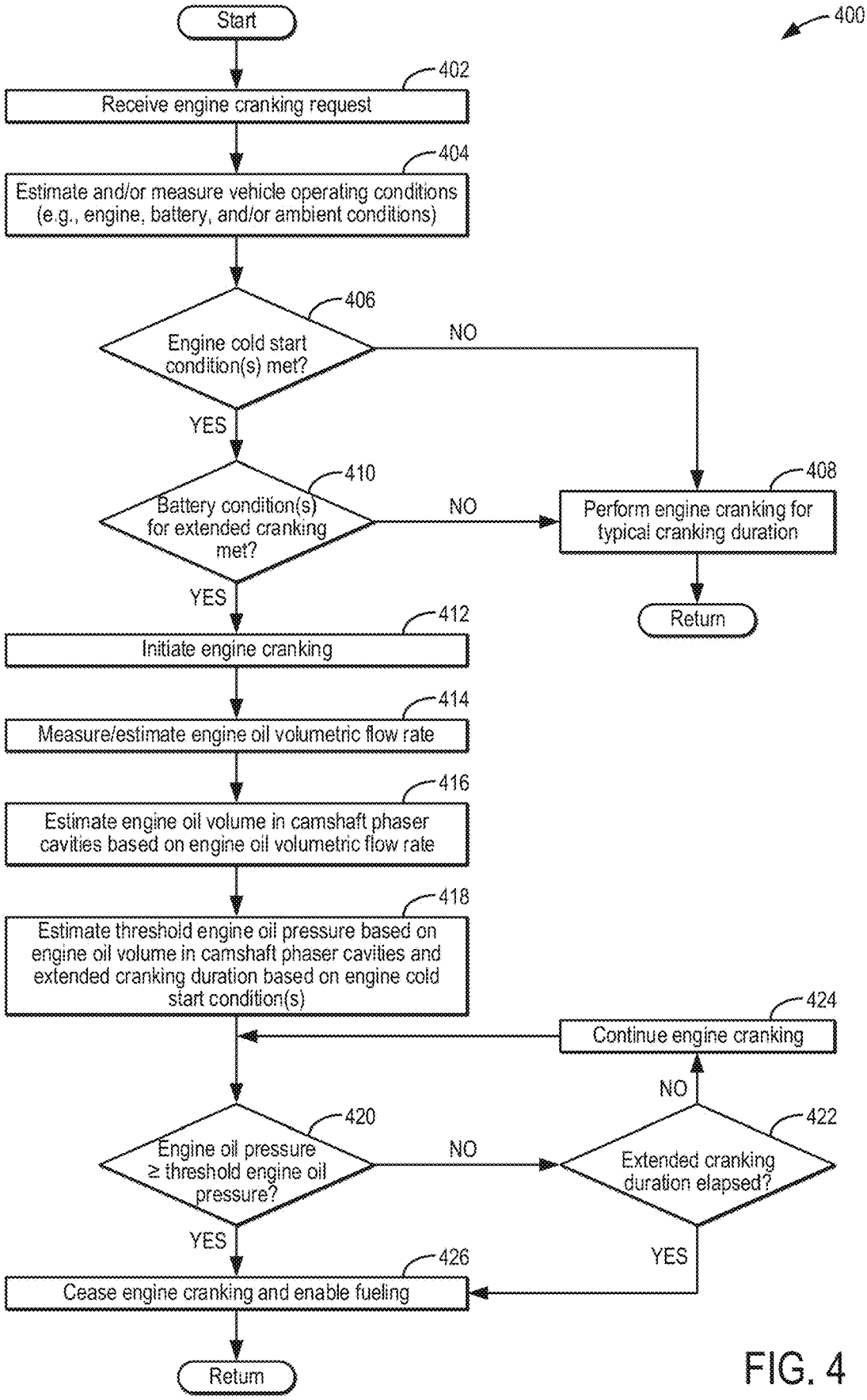
FIG. 4 shows a flow chart of a method for extending engine cranking during an engine cold start event.
Figure 5:
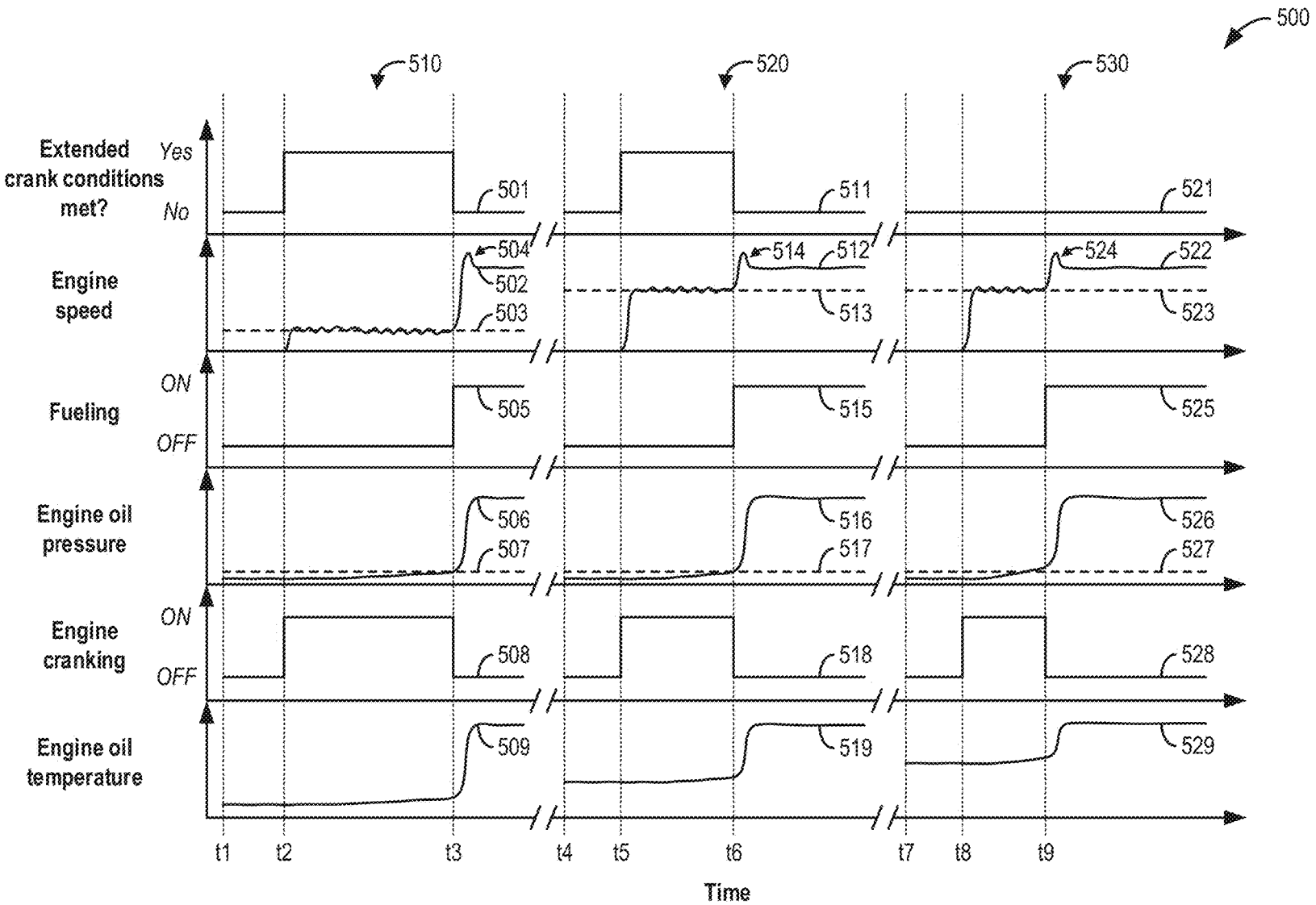
FIG. 5 shows prophetic examples of adjusting engine cranking during engine startup.

Specifically, and referring now to FIG. 4, a flow chart of an example routine 400 for extending engine cranking in response to an engine cold start (e.g., in the engine system described above with reference to FIGS. 1-3B) is shown. In some embodiments, an engine controller (e.g., controller 12) may be operable to receive one or more current conditions of a battery (e.g., state of charge and/or current capacity of battery 158) and the engine cold start (e.g., engine soak time, engine oil temperature, engine coolant temperature, and/or ambient air temperature) from various sensors (e.g., temperature sensor 112) or other components of an engine system including the engine controller (such as a battery management system of battery 158). Upon receipt of the one or more current conditions, the engine controller may be operable to determine whether extended engine cranking is desired, for example, to increase an engine oil pressure to a plurality of camshaft phaser cavities (e.g., of VCT phaser 19) during the engine cold start, and whether extended engine cranking is manageable by the battery. The engine controller may subsequently monitor the engine oil pressure in the camshaft phaser cavities (e.g., via feedback from sensor 224*a* and/or sensor 224*b*) and determine when extended engine cranking may be ceased and fueling enabled based on whether the engine oil pressure has reached a threshold engine oil pressure (or, in some examples, whether a maximum extended cranking duration has elapsed). In this way, considerations as to fuel efficiency and mechanical wear to VCT phaser components may be balanced such that an overall engine performance may be optimized.

Instructions for carrying out routine 400 may be executed by the engine controller (e.g., controller 12) based on instructions stored on a memory (e.g., read-only memory chip 106) of the engine controller and in conjunction with signals received from various sensors (e.g., 112, 180, 224*a*, 224*b*, etc.) and other components of the engine system. Further, the engine controller may employ various engine actuators to adjust engine operation, e.g., to extend engine cranking, according to routine 400 as described below. As such, routine 400 may enable monitoring of the engine oil pressure during the engine cold start, such that VCT phaser components remain lubricated and/or actuatable during engine operation.

At 402, routine 400 may include receiving an engine cranking request. For example, engine cranking for a standard (typical) cranking duration may be requested upon a startup event of a vehicle, such as a vehicle operator actuating an ignition system (e.g., turning a key, depressing a mechanical button, etc.). However, fueling may not be enabled until engine cranking is determined ceased.

At 404, routine 400 may include estimating and/or measuring one or more vehicle operating conditions. In some embodiments, the one or more vehicle operating conditions may include one or more engine operating conditions, such as an engine speed, an engine load, an engine soak time, an engine temperature, an engine coolant temperature, an engine oil temperature, a fuel temperature, a current operator torque demand, a manifold pressure, a manifold air flow, an exhaust gas air-fuel ratio, etc. In additional or alternative embodiments, the one or more vehicle operating conditions may include one or more battery conditions, such as a battery temperature, a battery state of charge (SOC), a battery current capacity, etc. In additional or alternative embodiments, the one or more vehicle operating conditions may include one or more ambient air conditions (e.g., of a surrounding environment), such as an ambient air pressure, an ambient air humidity, an ambient air temperature, etc. The one or more vehicle operating conditions may be measured by one or more sensors communicatively coupled to the engine controller (e.g., the engine oil temperature may be measured directly via temperature sensor 112) or may be inferred based on available data (e.g., the engine temperature may be estimated from the engine coolant temperature measured via temperature sensor 112).

Routine 400 may use the one or more vehicle operating conditions to infer a current state of vehicle operation, and determine whether to alter the current state of vehicle operation at least based on one or more of the engine soak time, the engine coolant temperature, the engine oil temperature, the ambient air temperature, the battery SOC, and the battery current capacity. For example, at 406, routine 400 may include determining whether one or more engine cold start conditions are met. In some examples, the one or more engine cold start conditions may include one or more current vehicle operating conditions upon receiving a request for an engine cold start. For instance, the one or more engine cold start conditions may include the engine soak time being greater than a threshold engine soak time and/or the engine oil temperature being less than a threshold oil temperature, the engine coolant temperature being less than a threshold engine coolant temperature, and/or the ambient air temperature being less than a threshold ambient air temperature. If the one or more engine cold start conditions are met (e.g., if the engine soak time is greater than the threshold engine soak time and the engine oil temperature is less than the threshold engine oil temperature), routine 400 may proceed to 408, where routine 400 may include performing engine cranking for the standard cranking duration (the standard cranking duration may also be referred to herein as a first cranking duration, e.g., relative to a second, extended cranking duration) via actuation of a starter device. Specifically, because the one or more engine cold start conditions have been determined met, the engine controller may predict that the engine oil pressure in the plurality of camshaft phaser cavities will reach a threshold engine oil pressure prior to fueling being enabled, such that actuation of various VCT phaser components (e.g., a locking pin in a locking pocket) may be executed without excessive degradation or mechanical inefficiencies.

If the one or more engine cold start conditions are not met (e.g., if the engine soak time is less than or equal to the threshold engine soak time and/or the engine oil temperature is greater than or equal to the threshold engine oil temperature), routine 400 may proceed to 410, where routine 400 may include determining whether one or more battery conditions for extended cranking are met. In some examples, the one or more battery conditions may include one or more current battery conditions upon receiving the request for the engine cold start. For instance, the one or more battery conditions may include the battery SOC being greater than a threshold battery SOC and/or the battery current capacity being greater than threshold battery current capacity. If the one or more battery conditions are not met (e.g., if the battery SOC is less than or equal to the threshold battery SOC and the battery current capacity is less than or equal to the threshold battery current capacity), routine 400 may proceed to 408, where routine 400 may include performing engine cranking for the standard cranking duration, as described above. Specifically, because the one or more battery conditions have been determined not to be met, the engine controller may determine that the battery is not able to provide power for performing extended engine cranking.

If the one or more engine cold start conditions and the one or more battery conditions are met, the engine controller may infer that the engine oil pressure in the plurality of camshaft phaser cavities is below the threshold engine oil pressure (e.g., upon the engine cold start) and that the battery is able to provide power for performing extended engine cranking. Accordingly, in some examples, the threshold battery SOC and threshold battery current capacity may be selected such that the power is available to the engine system and that a nonzero battery SOC remains following the extended engine cranking.

At 412, routine 400 may include initiating engine cranking. Specifically, initiation of engine cranking may include initiating rotation of the engine, which may result in increases to each of the engine oil pressure in the plurality of camshaft phaser cavities and an engine oil volumetric flow rate in the VCT phaser. Engine cranking may be initiated via actuation of a starter device, where an engine cranking speed (and thus a rate at which the engine oil pressure in the plurality of camshaft phaser cavities increases) may be based on a specific configuration of the starter device. For example, the starter device may be an SM, a BISG, or a CISG.

To parametrize an extended cranking duration (where the extended cranking duration may be considered extended relative to the standard cranking duration, e.g., the second, extended cranking duration may be longer than the first, standard cranking duration) such that engine cranking is not performed for an excessive duration, routine 400 may proceed to 414, where routine 400 may include measuring or estimating the engine oil volumetric flow rate (e.g., a volumetric flow rate of an amount of engine oil flowing along an engine oil flow path and through the plurality of camshaft phasers). For example, in some embodiments, an oil flow sensor (e.g., 224*a*, 224*b*) may directly measure the engine oil volumetric flow rate and transmit a signal indicative of the engine oil volumetric flow rate to the engine controller.

However, in other embodiments, the engine system may include no sensor capable of directly measuring the engine oil volumetric flow rate, or the one or more vehicle operating conditions may not be optimal for expected operation of such a sensor. In such embodiments, a model stored in memory of the engine controller may be employed to estimate the engine oil volumetric flow rate. For example, the Poiseuille equation may be utilized to determine the engine oil volumetric flow rate based on a geometry of the engine oil flow path and an engine oil pressure difference across the engine oil flow path as follows:

$$Q_{oil} = \frac{A^2 \Delta p_{oil}}{8\pi\mu L} \tag{1}$$

where $Q_{oil}$ is the engine oil volumetric flow rate, $A^2$ is a cross-sectional area of the engine oil flow path, $\Delta p_{oil}$ is the engine oil pressure difference across the engine oil flow path, μ is a dynamic viscosity of the engine oil, and L is a length of the engine oil flow path. The cross-sectional area and the length of the engine oil flow path may be fixed values, dependent on a specific configuration of the engine system. Similarly, the dynamic viscosity of the engine oil may be considered a fixed value for a given engine oil composition or grade. As such, equation (1) may be considered dependent on the engine oil pressure difference alone, as measured by sensors positioned at upstream and downstream ends of the engine oil flow path (e.g., sensors 224*a*, 224*b*).

At 416, routine 400 may include estimating an engine oil volume in the plurality of camshaft phaser cavities based on the engine oil volumetric flow rate. The engine oil volume in the plurality of camshaft phaser cavities may be a portion of an overall engine oil volume in an engine oil lubrication system included within the engine system (e.g., to lubricate and/or actuate various VCT phaser components). In some embodiments, the engine oil volume in the plurality of camshaft phaser cavities may be determined by integrating the engine oil volumetric flow rate over a predetermined duration, e.g., $$V_{oil} = \int_{t_i}^{t_f} Q_{oil} dt \tag{2}$$

where $t_i$ is a time at a beginning of the predetermined duration, $t_f$ is a time at an end of the predetermined duration, and $V_{oil}$ is the engine oil volume in the plurality of camshaft phaser cavities.

The engine oil volumetric flow rate may be increased so as to more efficiently lubricate and/or actuate the various VCT phaser components. Upon increasing the engine oil volumetric flow rate, the engine oil volume may desirably fill the plurality of camshaft phaser cavities at or above a threshold engine oil volume (where the threshold engine oil volume may correspond to an amount of engine oil expected to prevent rattle of a plurality of camshaft phasers upon flowing to the plurality of camshaft phaser cavities corresponding thereto, for example). To increase the engine oil volumetric flow rate such that the desirable engine oil volume is achieved prior to engine fueling, an increase in an engine oil pressure in the plurality of camshaft phaser cavities may be monitored during extended engine cranking until a threshold engine oil pressure is reached (the engine oil pressure being a directly measurable substitute variable for the engine oil volume). In increasing the engine oil volumetric flow rate and thereby the engine oil volume and the engine oil pressure in the plurality of camshaft phaser cavities, a number of assumptions may be taken into consideration at the engine controller. For example, if the engine system includes a mechanical oil pump, the engine oil pressure may be assumed to increase with the engine speed and decrease with an engine oil viscosity for a given engine oil volumetric flow rate. Further, the engine oil viscosity may decrease as the engine oil temperature increases for a given engine oil composition or grade, thereby increasing the engine oil volumetric flow rate. As such, increasing the engine oil volumetric flow rate may be considered a function of the engine oil viscosity and the engine oil pressure in the plurality of camshaft phaser cavities (accounting for any engine oil leakage or engine oil diverted to other passages).

At 418, routine 400 may include estimating each of the threshold engine oil pressure based on the engine oil volume in the plurality of camshaft phaser cavities and a maximum extended cranking duration based on the one or more engine cold start conditions. In some embodiments, the threshold engine oil pressure may be dynamically estimated based on a difference between a current engine oil volume in the plurality of camshaft phaser cavities (e.g., estimated at 416) and the (threshold) engine oil volume sufficient to fill the plurality of camshaft phaser cavities. In such embodiments, engine cranking may be extended until the engine oil pressure in the plurality of camshaft phaser cavities has increased to greater than or equal to the threshold engine oil pressure during extended engine cranking. Accordingly, a duration of engine cranking may be inversely dependent upon the engine oil volume (e.g., the duration of engine cranking may be relatively short when the engine oil volume is relatively high and the duration of engine cranking may be relatively long when the engine oil volume is relatively low). In certain embodiments, the current engine oil volume in the plurality of camshaft phaser cavities (e.g., estimated at 416) may be employed to estimate and monitor a current engine oil pressure in the plurality of camshaft phaser cavities (when the pressure sensor is not present or the one or more vehicle operating conditions are not optimal for expected operation of the pressure sensor, for example).

However, in some examples, the engine oil pressure in the plurality of camshaft phaser cavities may reach the threshold engine oil pressure after extending engine cranking for an undesirably lengthy duration. Accordingly, the one or more engine cold start conditions may be leveraged to determine the maximum extended cranking duration. Specifically, the maximum extended cranking duration may be a function of one or more of the engine soak time, the engine oil temperature, the engine coolant temperature, and the ambient air temperature. In additional or alternative embodiments, the maximum extended cranking duration may further be a function of the engine oil volume in the plurality of camshaft phaser cavities. For instance, the maximum extended cranking duration may be relatively short when the engine oil volume in the plurality of camshaft phaser cavities is relatively high (e.g., a shorter maximum engine cranking duration may be determined to increase the engine oil volume to the threshold engine oil volume), and the maximum extended cranking duration may be relatively long when the engine oil volume of the plurality of camshaft phaser cavities is relatively low (e.g., a longer maximum engine cranking duration may be determined to increase the engine oil volume to the threshold engine oil volume).

At 420, routine 400 may include determining whether the engine oil pressure in the plurality of camshaft phaser cavities has increased greater than or equal to the threshold engine oil pressure. If the engine oil pressure in the plurality of camshaft phaser cavities is determined to be less than the threshold engine oil pressure, routine 400 may proceed to 422, where routine 400 may include determining whether the maximum extended cranking duration has elapsed. If the maximum extended cranking duration has not elapsed, routine 400 may proceed to 424, where routine 400 may include continuing engine cranking. Routine 400 may return to 420.

If the engine oil pressure in the plurality of camshaft phaser cavities has increased to greater than or equal to the threshold engine oil pressure at 420, or if the maximum extended cranking duration is determined to have elapsed at 422, routine 400 may proceed to 426, where routine 400 may include ceasing engine cranking and enabling fueling of the engine system. In this way, routine 400 may reduce mechanical wear on the various components of the VCT phaser system while accounting for fuel efficiency and consumer satisfaction.

Referring now to FIG. 5, a timeline 500 depicting three example operations 510, 520, 530 of adjusting engine cranking during engine startup (e.g., during an engine cold start event) is shown. Each of the three example operations 510, 520, 530 may utilize substantially the same routine for engine cranking adjustment, such as routine 400 described above with reference to FIG. 4. Specifically, upon receiving an engine startup request, an engine controller (e.g., a PCM) may determine whether one or more extended crank conditions are met. If the one or more extended crank conditions are met, then engine cranking may be extended so as to increase an engine oil pressure in a plurality of camshaft phaser cavities in a VCT phaser until a threshold engine oil pressure is reached (at which point, engine cranking may cease and engine fueling may be enabled).

A duration of extended engine cranking may depend on a starter device being employed for executing engine cranking, as a cranking speed may depend on a selection of the starter device. To illustrate differences in engine operation based on starter device selection, a first example operation 510 may correspond to engine cranking with an SM and each of a second example operation 520 and a third example operation 530 may correspond to engine cranking with a BISG (where the one or more extended crank conditions are met in the second example operation 520 and the one or more extended crank conditions are not met in the third example operation 530). As such, though each of the example operations 510, 520, 530 are depicted along a single abscissa, the example operations 510, 520, 530 may not necessarily correspond to a single engine system.

Timeline 500 depicts whether or not the one or more extended crank conditions are met at solid curves 501, 511, and 521, an engine speed at solid curves 502, 512, and 522, engine fueling at solid curves 505, 515, and 525, an engine oil pressure in the plurality of camshaft phaser cavities at solid curves 506, 516, and 526, engine cranking at solid curves 508, 518, and 528, and an engine oil temperature at solid curves 509, 519, and 529. Additionally, dashed curves 503, 513, and 523 each represent a cranking speed at which a corresponding starter device operates, 504, 514, and 524 each indicate an engine speed transient, and dashed curves 507, 517, and 527 each represent a threshold engine oil pressure. All curves are depicted over time and plotted along an abscissa, where time increases from left to right of the abscissa. Further, a dependent variable represented by each curve discussed above is plotted along a corresponding ordinate, where the dependent variable increases from bottom to top of the given ordinate (unless otherwise stated or shown).

Referring now to the first example operation 510, between t1 and t2, an engine system including an SM as a starter device may be shut down (e.g., having a speed of zero, without combustion occurring). At t2, responsive to an engine startup request, the engine controller determines that the one or more extended crank conditions are met (curve 501). As an example, the one or more engine crank conditions may include one or more battery conditions and one or more engine cold start conditions. Accordingly, the one or more engine crank conditions being met may indicate that a battery coupled to the starter device may have sufficient power for extended engine cranking and that the engine startup request correlates to an engine cold start event. Further, the one or more engine crank conditions may at least include the engine oil pressure in the plurality of camshaft phaser cavities (curve 506) being less than the threshold engine oil pressure (curve 507).

Responsive to the one or more extended crank conditions being met at t2 (curve 501), engine cranking may be initiated (curve 508) and the engine speed (curve 502) may increase to the cranking speed (curve 503), where the engine speed may remain until fueling is enabled (curve 506). Between t2 and t3, however, fueling may remain disabled while engine cranking continues.

As a result of engine cranking being enabled (curve 508), each of the engine oil pressure in the plurality of camshaft phaser cavities (curve 506) and the engine oil temperature (curve 509) may slowly increase. Specifically, slowly increasing the engine oil temperature may decrease an engine oil viscosity such that an engine oil volumetric flow rate may increase, thereby further increasing the engine oil pressure in the plurality of camshaft phaser cavities.

At t3, the engine oil pressure in the camshaft phaser cavities (curve 506) may reach the threshold engine oil pressure (curve 507). Accordingly, the one or more engine crank conditions (curve 501), at least including the engine oil pressure in the camshaft phaser cavities being less than the threshold engine oil pressure, may no longer be met at t3, and engine cranking may cease (curve 508). Further, at t3, fueling may be enabled (curve 509), such that the engine speed (curve 502) may sharply increase as combustion of fuel in the engine system is initiated. Each of the engine oil pressure (curve 507) and the engine oil temperature (curve 509) may also increase more rapidly upon fuel combustion.

Following t3, an engine speed transient (e.g., a relatively brief period of negative acceleration; as indicated at 504) may occur. During such engine speed transients, a locking pin of the VCT phaser of the engine system may be actuated, such that the locking pin is mechanically or otherwise coerced into a locking pocket. Since the engine oil pressure is above the threshold engine oil pressure following t3, sufficient lubrication may be provided at the locking pin such that successful engagement of the locking pocket may be realized without substantial noise, vibration, and harshness (NVH) issues.

After the engine speed transient (indicated at 504), the engine system may operate according to typical engine operation. At a later point in time (e.g., during a break in the abscissa between t3 and t4), the engine system may shut down.

Referring now to the second example operation 520, between t4 and t5, an engine system including a BISG may be shut down (e.g., having a speed of zero, without combustion occurring). At t5, responsive to an engine startup request, the engine controller determines that the one or more extended crank conditions are met (curve 511). As an example, the one or more engine crank conditions may include one or more battery conditions and one or more engine cold start conditions. Accordingly, the one or more engine crank conditions being met may indicate that a battery coupled to the starter device may have sufficient power for extended engine cranking and that the engine startup request correlates to an engine cold start event. Further, the one or more engine crank conditions may at least include the engine oil pressure in the plurality of camshaft phaser cavities (curve 516) being less than the threshold engine oil pressure (curve 517).

Responsive to the one or more extended crank conditions being met at t5 (curve 511), engine cranking may be initiated (curve 518) and the engine speed (curve 512) may increase to the cranking speed (curve 513), where the engine speed may remain until fueling is enabled (curve 516). Between t5 and t6, however, fueling may remain disabled while engine cranking continues.

As a result of engine cranking being enabled (curve 518), each of the engine oil pressure in the plurality of camshaft phaser cavities (curve 516) and the engine oil temperature (curve 519) may slowly increase. Specifically, slowly increasing the engine oil temperature may decrease an engine oil viscosity such that an engine oil volumetric flow rate may increase, thereby further increasing the engine oil pressure in the plurality of camshaft phaser cavities.

At t6, the engine oil pressure in the camshaft phaser cavities (curve 516) may reach the threshold engine oil pressure (curve 517). Accordingly, the one or more engine crank conditions (curve 511), at least including the engine oil pressure in the camshaft phaser cavities being less than the threshold engine oil pressure, may no longer be met at t6, and engine cranking may cease (curve 518). Further, at t6, fueling may be enabled (curve 519), such that the engine speed (curve 512) may sharply increase as combustion of fuel in the engine system is initiated. Each of the engine oil pressure (curve 517) and the engine oil temperature (curve 519) may also increase more rapidly upon fuel combustion.

Following t6, an engine speed transient (e.g., a relatively brief period of negative acceleration; as indicated at 514) may occur. During such engine speed transients, a locking pin of the VCT phaser of the engine system may be actuated, such that the locking pin is mechanically or otherwise coerced into a locking pocket. Since the engine oil pressure is above the threshold engine oil pressure following t6, sufficient lubrication may be provided at the locking pin such that successful engagement of the locking pocket may be realized without substantial NVH issues.

After the engine speed transient (indicated at 514), the engine system may operate according to typical engine operation. At a later point in time (e.g., during a break in the abscissa between t6 and t7), the engine system may shut down.

The starter device being the SM in the first example operation 510, the cranking speed (curve 503) may be relatively low. As such, the engine oil pressure in the plurality of camshaft phaser cavities (curve 506) may increase during engine cranking (curve 508) at a correspondingly slow rate. However, in the second example operation 520, where the starter device is the BISG, the cranking speed (curve 513) may be relatively high (e.g., higher than the cranking speed in the first example operation 510). As such, the engine oil pressure in the plurality of camshaft phaser cavities (curve 516) may increase more rapidly during engine cranking (curve 518) in the second example operation 520 than the first example operation 510, such that an overall engine cranking duration is significantly less during the second example operation 520 than the first example operation 510. Further, the engine oil temperature (curve 519) at a beginning (e.g., at t4) of the second example operation 520 is higher than the engine oil temperature (curve 509) at a beginning (e.g., at t4) of the first example operation 510, further increasing a rate of the engine oil pressure in the second example operation 520 relative to the first example operation 510.

Referring now to the third example operation 530, between t7 and t8, an engine system including a BISG may be shut down (e.g., having a speed of zero, without combustion occurring). At t8, responsive to an engine startup request, the engine controller determines that the one or more extended crank conditions are not met (curve 521). As an example, the one or more engine crank conditions may include one or more battery conditions and one or more engine cold start conditions. Accordingly, the one or more engine crank conditions not being met may indicate that a battery coupled to the starter device may not have sufficient power for extended engine cranking and/or that the engine startup request may not correlate to an engine cold start event [as shown, the engine oil temperature (curve 529) is relatively high at t7, indicative that engine startup is not a cold start]. Further, at t8, the engine oil pressure in the plurality of camshaft phaser cavities (curve 526) may be less than the threshold engine oil pressure (curve 527).

Responsive to the one or more extended crank conditions not being met at t5 (curve 521), typical engine cranking may be initiated (curve 528) and the engine speed (curve 522) may increase to the cranking speed (curve 523), where the engine speed may remain until fueling is enabled (curve 526). Between t8 and t9, however, fueling may remain disabled while engine cranking continues.

As a result of engine cranking being enabled (curve 528), each of the engine oil pressure in the plurality of camshaft phaser cavities (curve 526) and the engine oil temperature (curve 529) may slowly increase. Specifically, slowly increasing the engine oil temperature may decrease an engine oil viscosity such that an engine oil volumetric flow rate may increase, thereby further increasing the engine oil pressure in the plurality of camshaft phaser cavities.

Further, between t8 and t9, the engine oil pressure in the camshaft phaser cavities (curve 516) may reach the threshold engine oil pressure (curve 517). In the third example operation 530 (and unlike the first and second example operations 510, 520), engine cranking (curve 528) may continue until a predetermined duration for typical engine cranking has elapsed. Accordingly, after the predetermined duration has elapsed at t9, and engine cranking may cease (curve 528). Further, at t9, fueling may be enabled (curve 529), such that the engine speed (curve 522) may sharply increase as combustion of fuel in the engine system is initiated. Each of the engine oil pressure (curve 527) and the engine oil temperature (curve 529) may also increase more rapidly upon fuel combustion.

Following t9, an engine speed transient (e.g., a relatively brief period of negative acceleration; as indicated at 524) may occur. During such engine speed transients, a locking pin of the VCT phaser of the engine system may be actuated, such that the locking pin is mechanically or otherwise coerced into a locking pocket. Since the engine oil pressure is above the threshold engine oil pressure following t9, sufficient lubrication may be provided at the locking pin such that successful engagement of the locking pocket may be realized without substantial NVH issues.

After the engine speed transient (indicated at 524), the engine system may operate according to typical engine operation. At a later point in time (e.g., after t9), the engine system may shut down.

The starter device being the BISG in both the second and third example operations 520, 530, the cranking speed (curves 513, 523) may be the same. However, while the one or more extended crank conditions are met (curve 511) in the second example operation 520, the one or more extended crank conditions are not met (curve 521) in the third example operation 530. For example, the engine oil temperature (curve 529) at a beginning of the third example operation 530 is higher than the engine oil temperature (curve 519) at a beginning of the second example operation 520, indicating that the third example operation 530 depicts a warmer start. Further, at least because the engine oil temperature in the third example operation 530 is relatively high, the engine oil pressure (curve 526) may increase more rapidly during engine cranking (curve 528) in the third example operation 530 than the second example operation 520, such that no extended engine cranking may be employed in the third example operation 530 [e.g., as the engine oil pressure reaches the threshold engine oil pressure (curve 527) within the predetermined duration for typical engine cranking in the third example operation 530].

Figure 6:
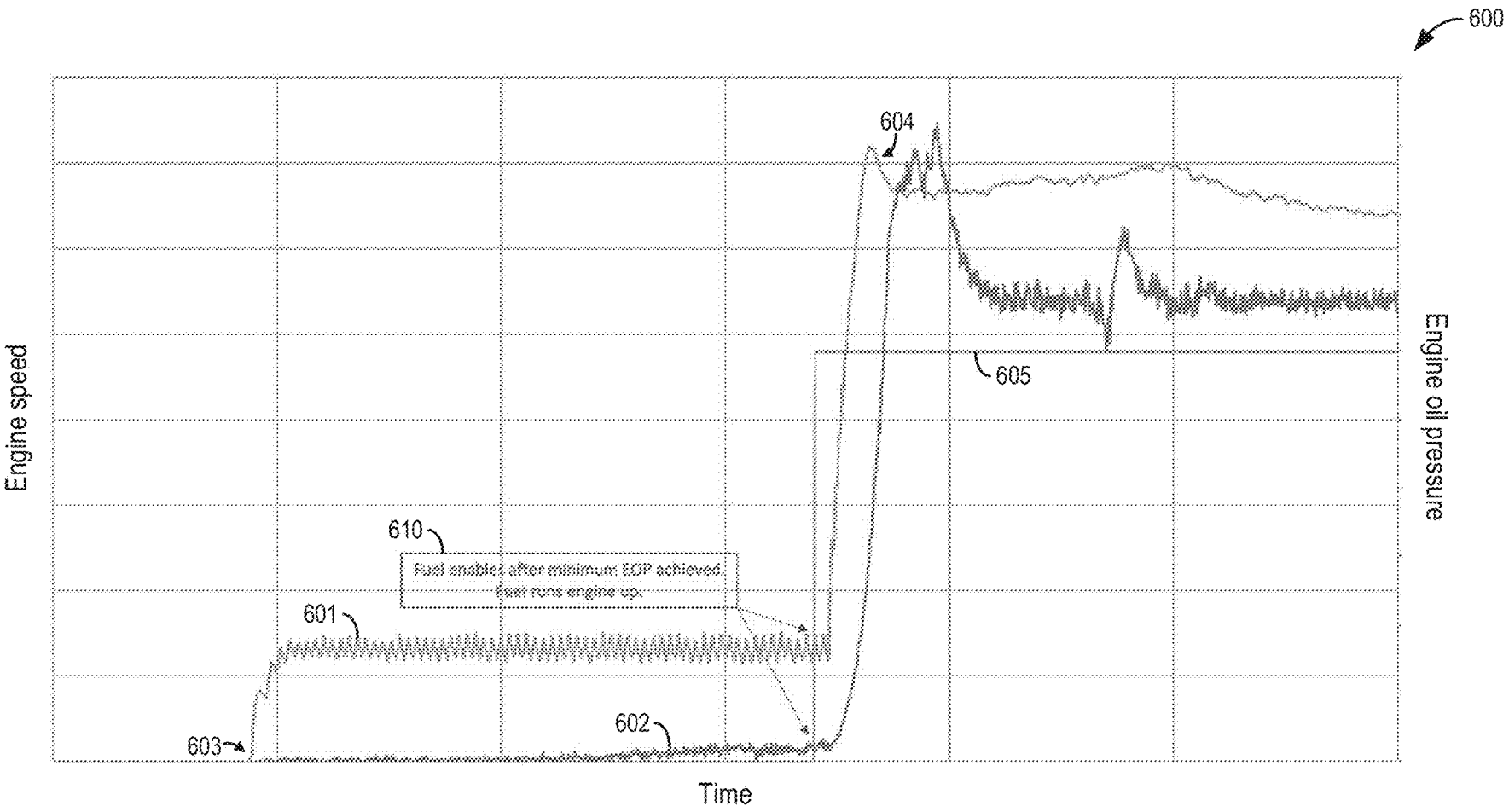
FIG. 6 shows a plot illustrating extended engine cranking via a starter motor during an engine cold start event.

Referring now to FIG. 6, an example plot 600 showing extension of engine cranking via an SM so as to increase an engine oil pressure during an engine cold start event is depicted. Specifically, the engine oil pressure may desirably be increased such that lubrication and/or actuation of various components of a VCT phaser may be enabled. Accordingly, during engine startup events where the engine oil pressure may be particularly low or increasing at a particularly slow rate, engine cranking may be extended prior to fueling to prevent rattle from insufficient lubrication of the VCT phaser (for example, rattle due to incomplete engagement of a locking pin of the VCT phaser in a corresponding locking pocket during an engine speed transient).

As shown in example plot 600, an abscissa represents time, and left and right ordinates represent respective dependent variables plotted over time. Specifically, curve 601 indicates an engine speed (plotted over time according to the left ordinate), curve 602 indicates the engine oil pressure (plotted over time according to the right ordinate), and curve 605 indicates engine fueling (e.g., a step function, where zero values indicate no engine fueling and nonzero values indicate engine fueling is enabled).

As indicated at 603, an engine cold start event is initiated in cold ambient conditions (e.g., an engine soak time being greater than a threshold engine soak time and each of an engine coolant temperature, an engine oil temperature, and an ambient air temperature being less than respective threshold temperatures). Immediately following the engine cold start event, and as shown by curve 601, engine cranking provided by the SM may be initiated to increase the engine speed to a relatively constant cranking speed of ~200-250 rpm. Due to the cold ambient conditions, an engine oil viscosity may initially be relatively high, resulting in a correspondingly slow initial engine oil volumetric flow rate. Accordingly, components of the VCT phaser may take longer to fill/lubricate than in warm ambient conditions. However, the cranking speed may influence a rate at which the engine oil pressure, and thereby the engine oil volumetric flow rate, increases (as shown by curve 602). An engine controller (e.g., PCM) may monitor the increasing engine oil pressure (and thus substantially continuously estimate an engine oil volume within cavities of the VCT phaser) until the engine oil pressure/volume reaches a minimum threshold to lubricate and/or actuate the components of the VCT phaser (at which point engine cranking ceases and engine fueling is enabled, as indicated at 610). Once engine fueling is enabled (as shown by curve 605), combustion run up may commence, followed by a brief period of negative acceleration (also referred to herein as an engine speed transient, as indicated at 604). In this way, due to the components of the VCT phaser being sufficiently lubricated (by the increased engine oil volume), rattle and other NVH issues may be mitigated during the engine speed transient.

Figure 7:
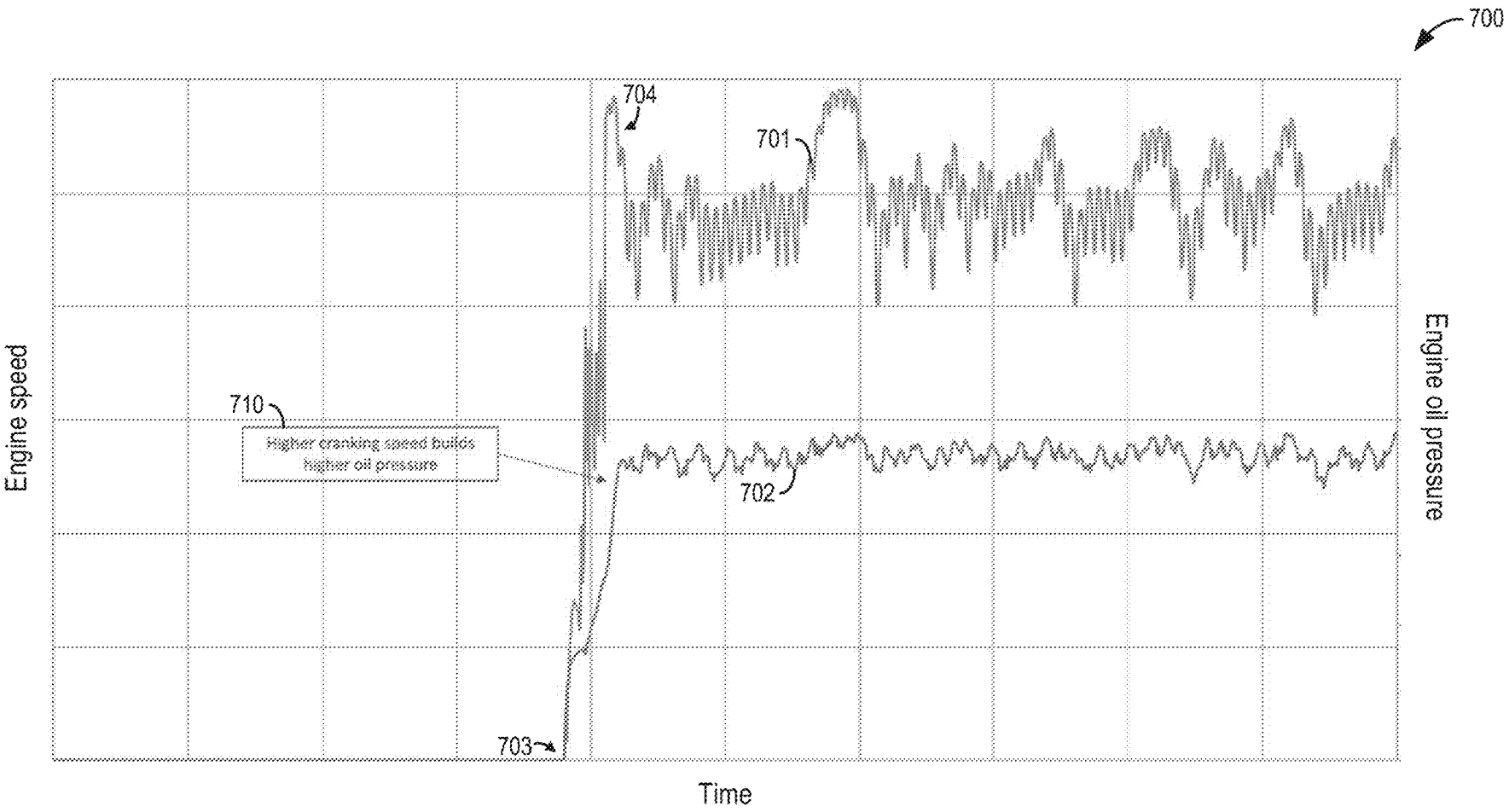
FIG. 7 shows a plot illustrating extended engine cranking via a belt integrated starter generator during an engine cold start event.

Referring now to FIG. 7, an example plot 700 showing extension of engine cranking via a BISG so as to increase an engine oil pressure during an engine cold start event is depicted. Specifically, and as similarly described above with reference to FIG. 6, the engine oil pressure may desirably be increased such that lubrication and/or actuation of various components of a VCT phaser may be enabled. Accordingly, during engine startup events where the engine oil pressure may be particularly low or increasing at a particularly slow rate, engine cranking may be extended prior to fueling to prevent rattle from insufficient lubrication of the VCT phaser (for example, rattle due to incomplete engagement of a locking pin of the VCT phaser in a corresponding locking pocket during an engine speed transient).

As shown in example plot 700, an abscissa represents time, and left and right ordinates represent respective dependent variables plotted over time. Specifically, curve 701 indicates an engine speed (plotted over time according to the left ordinate) and curve 702 indicates the engine oil pressure (plotted over time according to the right ordinate).

As indicated at 703, an engine cold start event is initiated in cold ambient conditions (e.g., an engine soak time being greater than a threshold engine soak time and each of an engine coolant temperature, an engine oil temperature, and an ambient air temperature being less than respective threshold temperatures). Immediately following the engine cold start event, and as shown by curve 701, engine cranking provided by the BISG may be initiated to increase the engine speed to a relatively constant cranking speed of greater than ~500 rpm. Due to the cold ambient conditions, an engine oil viscosity may initially be relatively high, resulting in a correspondingly slow initial engine oil volumetric flow rate. Accordingly, components of the VCT phaser may take longer to fill/lubricate than in warm ambient conditions. However, the cranking speed may influence a rate at which the engine oil pressure, and thereby the engine oil volumetric flow rate, increases (as shown by curve 702). Specifically, and as compared to performing engine cranking via the SM as described above with reference to FIG. 6, the engine oil pressure may build more rapidly with the higher cranking speed of the BISG (as indicated at 710) and thus an overall engine cranking duration may be shorter.

An engine controller (e.g., PCM) may monitor the increasing engine oil pressure (and thus substantially continuously estimate an engine oil volume within cavities of the VCT phaser) until the engine oil pressure/volume reaches a minimum threshold to lubricate and/or actuate the components of the VCT phaser (at which point engine cranking ceases and engine fueling is enabled). Once engine fueling is enabled, combustion run up may commence, followed by a brief period of negative acceleration (also referred to herein as an engine speed transient, as indicated at 704). In this way, due to the components of the VCT phaser being sufficiently lubricated (by the increased engine oil volume), rattle and other NVH issues may be mitigated during the engine speed transient.

Figure 8:
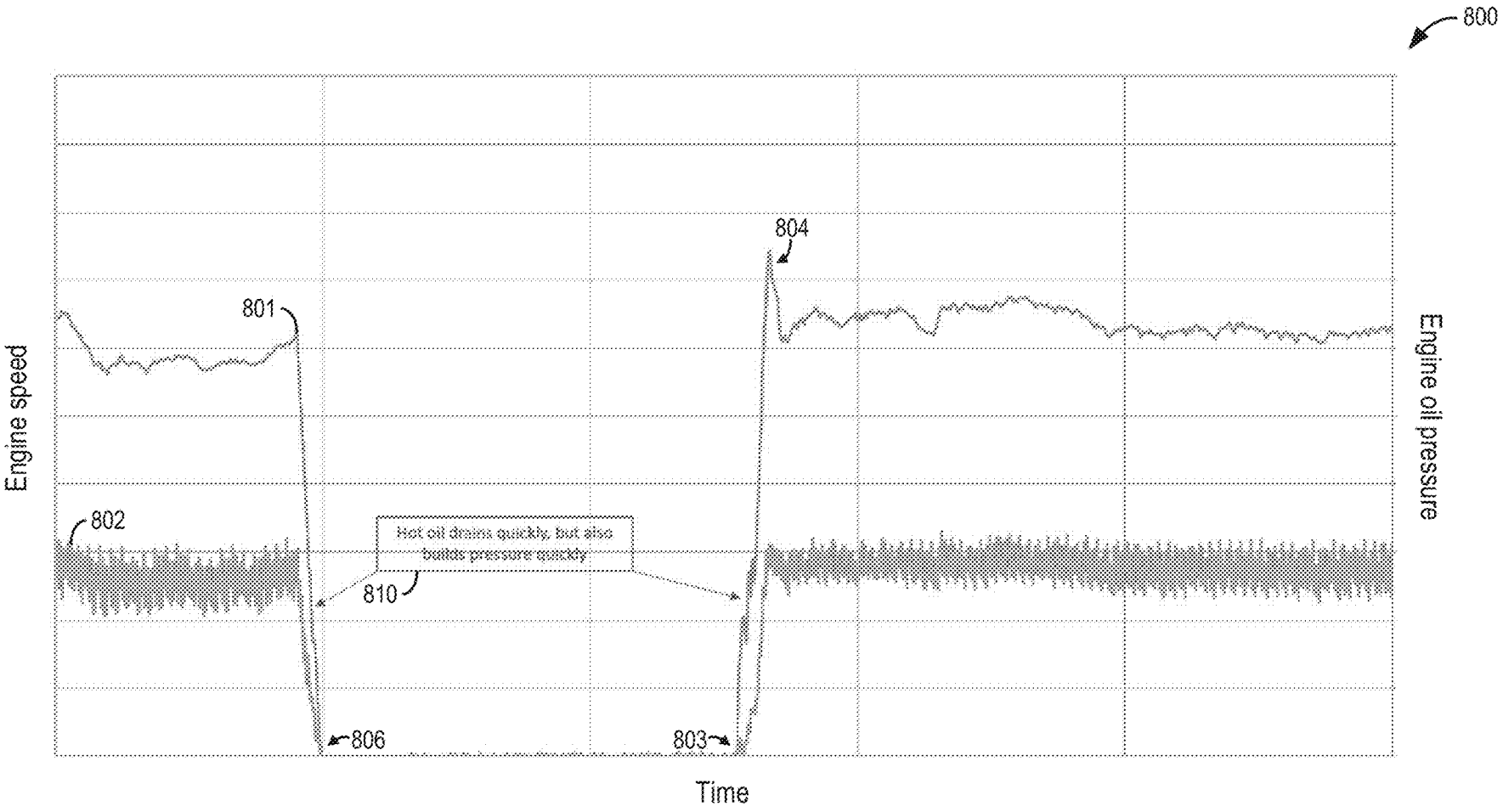
FIG. 8 shows a plot illustrating engine cranking via a starter motor during a transient stop/start event of a warm engine.

Referring now to FIG. 8, an example plot 800 showing engine cranking via a SM during a transient stop/start event of a relatively warm engine is depicted. Specifically, because the engine is shut down and then started up after a relatively brief engine soak time, an engine oil volumetric flow rate may be high enough such that a typical engine cranking duration may be sufficient to increase an engine oil pressure and provide lubrication and/or actuation various components of a VCT phaser (e.g., without actively extending engine cranking). Accordingly, rattle from insufficient lubrication of the VCT phaser may be mitigated with typical engine operation in warm ambient conditions (for example, rattle due to incomplete engagement of a locking pin of the VCT phaser in a corresponding locking pocket during an engine speed transient).

As shown in example plot 800, an abscissa represents time, and left and right ordinates represent respective dependent variables plotted over time. Specifically, curve 801 indicates an engine speed (plotted over time according to the left ordinate) and curve 802 indicates the engine oil pressure (plotted over time according to the right ordinate).

As indicated at 806, the engine shuts down and, as indicated at 810, relatively hot engine oil drains quickly, thereby rapidly decreasing the engine oil pressure (as shown by curve 802). While the engine is shut down, an engine controller (e.g., PCM) may substantially continuously monitor at least an engine soak time and an engine oil temperature to determine whether or not a subsequent engine startup corresponds to an engine cold start event.

As indicated at 803, the engine subsequently starts up in warm ambient conditions (e.g., after a relatively short engine soak time, indicating no engine cold start event). Further, and as again indicated at 810, the engine oil, still being relatively hot, builds engine oil pressure rapidly (as shown by curve 802). Accordingly, no extended engine cranking is implemented, as the engine oil pressure sufficiently increases to suppress rattle of the components of the VCT phaser during an engine speed transient upon engine fueling being enabled (e.g., combustion run up followed by a brief period of negative acceleration, as indicated at 804).

Figure 9:
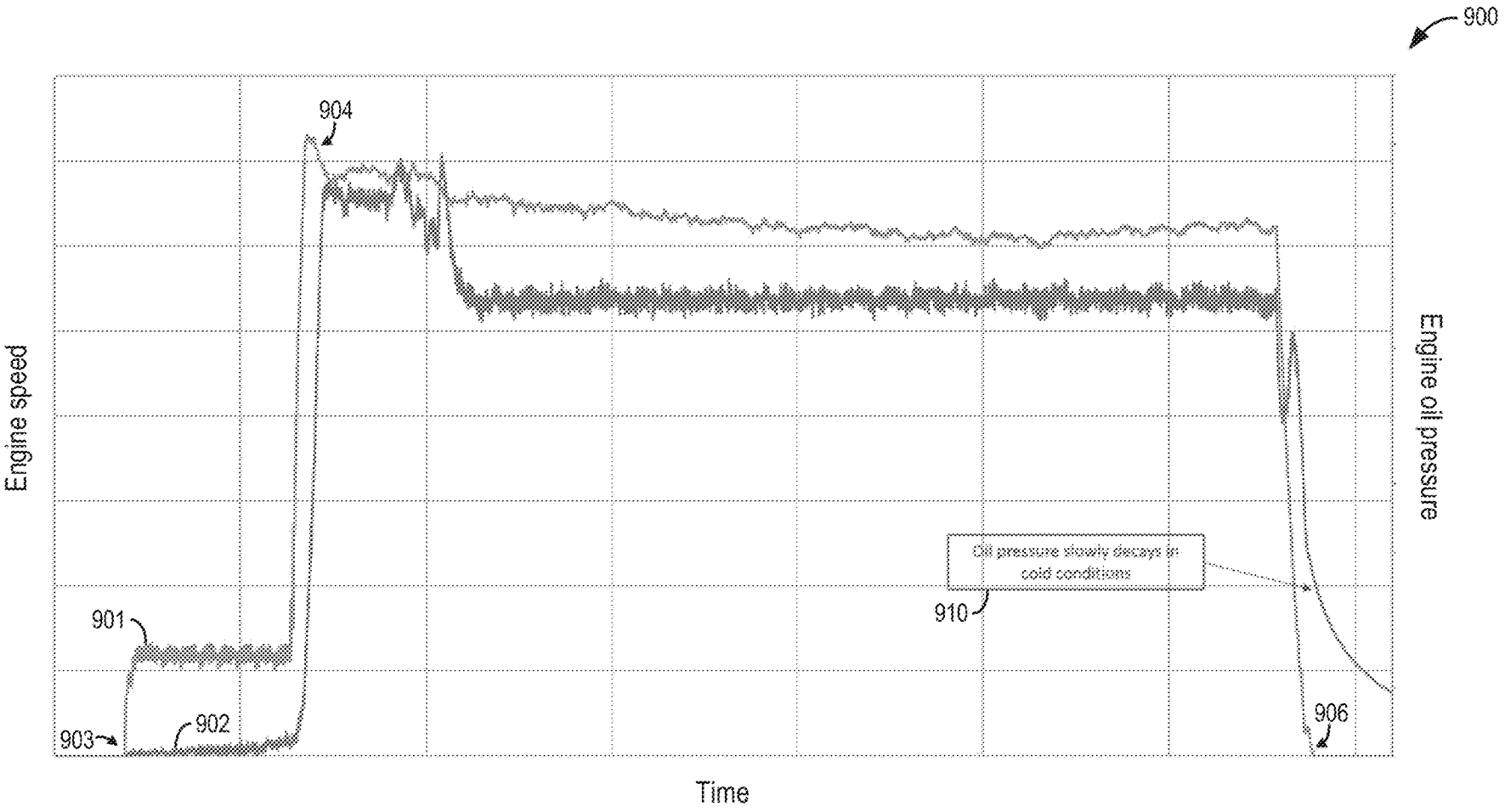
FIG. 9 shows a plot illustrating engine cranking via a starter motor during a transient start/stop event of a cold engine.

Referring now to FIG. 9, an example plot 900 showing engine cranking via an SM during a transient start/stop event of a relatively cold engine is depicted. Specifically, the engine is started up in cold ambient conditions (e.g., an engine cold start event) and then shut down during similarly cold ambient conditions. As such, even after extending engine cranking to increase an engine oil pressure to sufficiently lubricate and/or actuate components of a VCT phaser, engine oil may slowly drain due to the cold ambient conditions upon shutting down the engine lowering an engine oil viscosity (relative to warmer ambient conditions).

As shown in example plot 900, an abscissa represents time, and left and right ordinates represent respective dependent variables plotted over time. Specifically, curve 901 indicates an engine speed (plotted over time according to the left ordinate) and curve 902 indicates the engine oil pressure (plotted over time according to the right ordinate).

As indicated at 903, an engine cold start event is initiated in cold ambient conditions (e.g., an engine soak time being greater than a threshold engine soak time and each of an engine coolant temperature, an engine oil temperature, and an ambient air temperature being less than respective threshold temperatures). Immediately following the engine cold start event, and as shown by curve 901, engine cranking provided by the SM may be initiated to increase the engine speed to a relatively constant cranking speed of ~200-250 rpm. Due to the cold ambient conditions, an engine oil viscosity may be relatively high, resulting in a correspondingly slow engine oil volumetric flow rate. Accordingly, components of the VCT phaser may take longer to fill/lubricate than in warm ambient conditions. However, the cranking speed may influence a rate at which the engine oil pressure, and thereby the engine oil volumetric flow rate, increases (as shown by curve 902). An engine controller (e.g., PCM) may monitor the increasing engine oil pressure (and thus substantially continuously estimate an engine oil volume within cavities of the VCT phaser) until the engine oil pressure/volume reaches a minimum threshold to lubricate and/or actuate the components of the VCT phaser (at which point engine cranking ceases and engine fueling is enabled). Once engine fueling is enabled, combustion run up may commence, followed by a brief period of negative acceleration (also referred to herein as an engine speed transient, as indicated at 904). In this way, due to the components of the VCT phaser being sufficiently lubricated (by the increased engine oil volume), rattle and other NVH issues may be mitigated during the engine speed transient.

As indicated at 906, the engine subsequently shuts down and, as indicated at 910, engine oil drains relatively slowly as cold ambient conditions may persist, thereby more slowly dropping the engine oil pressure (as shown by curve 902). Accordingly, and as shown, the engine oil pressure may continue to slowly taper down until well after the engine shuts down. While the engine is shut down, an engine controller (e.g., PCM) may substantially continuously monitor at least an engine soak time and an engine oil temperature to determine whether or not a subsequent engine startup corresponds to an engine cold start event. As such, if a subsequent engine startup occurs soon after engine shutdown, the engine oil pressure may increase to the minimum threshold more rapidly than upon the engine cold start event at 903 (e.g., following a longer engine soak time).

In this way, systems and methods are provided for extending engine cranking during engine cold start events such that an engine oil pressure applied to camshaft phaser cavities of a variable camshaft timing (VCT) phaser may be increased. In some examples, by increasing the engine oil pressure, actuation and/or lubrication of VCT phaser components may be concomitantly increased. A technical effect of increasing the engine oil pressure in this way is that mechanical wear to the VCT phaser may be mitigated. For example, actuation and lubrication of a locking pin of the VCT phaser during engagement of a corresponding locking pocket may be provided via increased engine oil thereat. As a result, a locking mechanism of the VCT phaser may be enabled without substantial noise, vibration, and harshness (e.g., due to incomplete engagement of the locking pocket and poor lubrication of contact points of the locking pin with the locking pocket).

Further, in some examples, current engine cold start and engine oil conditions may be leveraged to minimize extension of engine cranking, while still extending engine cranking beyond a typical duration. As an example, a minimum engine oil pressure increase may be estimated based on a current engine oil volume (as opposed to assuming zero engine oil pressure). As another example, engine cranking may be subjected to an upper limit determined based on current engine cold start conditions. A technical effect of limiting an extended engine cranking duration in this way is that a threshold engine oil pressure may be achieved while enabling fueling as early as possible (thereby at least partially accounting for fuel efficiency tradeoffs).

In one example, a method, comprising, responsive to one or more engine cold start conditions: initiating engine cranking; estimating an engine oil volume in a plurality of camshaft phaser cavities; and extending engine cranking based on the engine oil volume and the one or more engine cold start conditions. A first example of the method further includes wherein the one or more engine cold start conditions comprises one or more of: an engine oil temperature less than a threshold engine oil temperature; an ambient air temperature less than a threshold ambient air temperature; an engine coolant temperature less than a threshold engine coolant temperature; and an engine soak time greater than a threshold engine soak time. A second example of the method, optionally including the first example of the method, further includes wherein estimating the engine oil volume comprises: determining an engine oil volumetric flow rate; and integrating the engine oil volumetric flow rate over a predetermined duration. A third example of the method, optionally including one or more of the first and second examples of the method, further includes wherein extending engine cranking based on the engine oil volume and the one or more engine cold start conditions comprises: estimating a maximum extended cranking duration based on the one or more engine cold start conditions; and extending engine cranking until an earlier of: an engine oil pressure reaching a threshold pressure, the threshold pressure corresponding to the engine oil volume; and the maximum extended cranking duration elapsing. A fourth example of the method, optionally including one or more of the first through third examples of the method, further includes wherein the threshold pressure is selected such that, upon the engine oil pressure reaching the threshold pressure, the engine oil volume fills the plurality of camshaft phaser cavities at or above a threshold volume. A fifth example of the method, optionally including one or more of the first through fourth examples of the method, further includes wherein a duration of engine cranking is inversely dependent upon the engine oil volume, such that the duration of engine cranking is relatively short when the engine oil volume is relatively high and the duration of engine cranking is relatively long when the engine oil volume is relatively low.

As another example, a system for an engine, the system comprising: a plurality of camshaft phasers; an amount of engine oil flowing through the plurality of camshaft phasers; and a powertrain control module storing instructions in non-transitory memory, the instructions executable to: receive a request to crank the engine for a standard duration; and responsive to an engine soak time being greater than a threshold soak time and at least one of an engine oil temperature, an ambient air temperature, and an engine coolant temperature being less than a respective threshold temperature, cranking the engine for an extended duration greater than the standard duration. A first example of the system further comprises an engine oil pressure sensor communicably coupled to the powertrain control module, wherein the instructions are further executable to: receive a signal from the engine oil pressure sensor, the signal indicative of a pressure of the amount of engine oil; and enable fueling of the engine upon determination of the pressure reaching a threshold pressure. A second example of the system, optionally including the first example of the system, further includes wherein the instructions are further executable to: receive a volumetric flow rate of the amount of engine oil; estimate a portion of the amount of engine oil filling cavities of the plurality of camshaft phasers; and determine the threshold pressure based on when the portion of the amount of engine oil filling the cavities of the plurality of camshaft phasers is predicted to reach a threshold portion. A third example of the system, optionally including one or more of the first and second examples of the system, further includes wherein the threshold portion is a portion of the amount of engine oil expected to prevent rattle of the plurality of camshaft phasers upon flowing to the cavities of the plurality of camshaft phasers. A fourth example of the system, optionally including one or more of the first through third examples of the system, further includes wherein the instructions are further executable to: receive a volumetric flow rate of the amount of engine oil; estimate a portion of the amount of engine oil filling cavities of the plurality of camshaft phasers; determine a threshold duration for cranking the engine based on the engine soak time and the at least one of the engine oil temperature, the ambient air temperature, and the engine coolant temperature; and cease cranking prior to or at the threshold duration. A fifth example of the system, optionally including one or more of the first through fourth examples of the system, further comprises an engine oil flow sensor communicably coupled to the powertrain control module, wherein receiving the volumetric flow rate comprises receiving a signal from the engine oil flow sensor, the signal indicative of the volumetric flow rate. A sixth example of the system, optionally including one or more of the first through fifth examples of the system, further includes wherein receiving the volumetric flow rate comprises estimating the volumetric flow rate based on a change in pressure of a portion of the amount of the engine oil flowing along an engine oil flow path. A seventh example of the system, optionally including one or more of the first through sixth examples of the system, further comprises a starter device configured for cranking the engine, the starter device being a starter motor, a belt integrated starter generator, or a crank integrated starter generator, wherein cranking the engine for the extended duration is initiated via actuation of the starter device.

As yet another example, a method, comprising, responsive to an engine oil temperature being below a threshold temperature: responsive to a plurality of battery conditions for extended cranking not being met, performing engine cranking for a first duration; and responsive to the plurality of battery conditions for extended cranking being met, performing engine cranking for a second duration, the second duration being greater than the first duration. A first example of the method further includes wherein the plurality of battery conditions for extended cranking comprises: a battery state of charge greater than a threshold state of charge; and a battery current capacity greater than a threshold current capacity. A second example of the method, optionally including the first example of the method, further comprises, responsive to the plurality of battery conditions for extended cranking being met: determining an engine oil volumetric flow rate; and estimating a threshold pressure based on the engine oil volumetric flow rate, the second duration being dependent on an engine oil pressure relative to the threshold pressure. A third example of the method, optionally including one or more of the first and second examples of the method, further includes wherein performing engine cranking for the second duration comprises: initiating engine cranking; estimating an extended cranking duration based on the engine oil temperature; and responsive to the engine oil pressure increasing to greater than or equal to the threshold pressure, ceasing engine cranking prior to the second duration reaching the extended cranking duration. A fourth example of the method, optionally including one or more of the first through third examples of the method, further includes wherein performing engine cranking for the second duration further comprises: initiating engine cranking; estimating an extended cranking duration based on the engine oil temperature; and responsive to the engine oil pressure increasing to less than the threshold pressure, ceasing engine cranking upon the second duration reaching the extended cranking duration. A fifth example of the method, optionally including one or more of the first through fourth examples of the method, further comprises, following performing engine cranking for the first duration or the second duration, enabling engine fueling.

In another representation, a method, comprising, during an engine cold start: performing engine cranking, a duration of engine cranking being extended to increase an engine oil volume in a plurality of camshaft phaser cavities; and following engine cranking, enabling engine fueling. A first example of the method further including wherein the engine oil volume is increased above a threshold engine oil volume during engine cranking. A second example of the method, optionally including the first example of the method, further comprising determining a maximum extended cranking duration, wherein the duration of engine cranking is less than or equal to the maximum extended cranking duration. A third example of the method, optionally including one or more of the first and second examples of the method, further including wherein the maximum extended cranking duration elapses prior to the engine oil volume increasing above a threshold engine oil volume. A fourth example of the method, optionally including one or more of the first through third examples of the method, further including wherein the maximum extended cranking duration is relatively short when the engine oil volume is relatively high and the maximum extended cranking duration is relatively long when the engine oil volume is relatively low. A fifth example of the method, optionally including one or more of the first through fourth examples of the method, further comprising, responsive to each of a battery state of charge (SOC) being less than a threshold battery SOC and a battery current capacity being less than a threshold battery current capacity, not extending the duration of engine cranking beyond a standard duration.

It will be appreciated that the configurations and routines disclosed herein are exemplary in nature, and that these specific embodiments are not to be considered in a limiting sense, because numerous variations are possible. Moreover, unless explicitly stated to the contrary, the terms "first," "second," "third," and the like are not intended to denote any order, position, quantity, or importance, but rather are used merely as labels to distinguish one element from another. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

responsive to one or more engine cold start conditions:

initiating engine cranking;

estimating an engine oil volume in a plurality of camshaft phaser cavities; and extending engine cranking based on the engine oil volume and the one or more engine cold start conditions.

2. The method of claim 1, wherein the one or more engine cold start conditions comprises one or more of:

an engine oil temperature less than a threshold engine oil temperature;

an ambient air temperature less than a threshold ambient air temperature;

an engine coolant temperature less than a threshold engine coolant temperature; and an engine soak time greater than a threshold engine soak time.

3. The method of claim 1, wherein estimating the engine oil volume comprises:

determining an engine oil volumetric flow rate; and integrating the engine oil volumetric flow rate over a predetermined duration.

4. The method of claim 1, wherein extending engine cranking based on the engine oil volume and the one or more engine cold start conditions comprises:

estimating a maximum extended cranking duration based on the one or more engine cold start conditions; and extending engine cranking until an earlier of:

an engine oil pressure reaching a threshold pressure, the threshold pressure corresponding to the engine oil volume; and the maximum extended cranking duration elapsing.

5. The method of claim 4, wherein the threshold pressure is selected such that, upon the engine oil pressure reaching the threshold pressure, the engine oil volume fills the plurality of camshaft phaser cavities at or above a threshold volume.

6. The method of claim 5, wherein a duration of engine cranking is inversely dependent upon the engine oil volume, such that the duration of engine cranking is relatively short when the engine oil volume is relatively high and the duration of engine cranking is relatively long when the engine oil volume is relatively low.

7. A system for an engine, the system comprising:

a plurality of camshaft phasers;

an amount of engine oil flowing through the plurality of camshaft phasers; and a powertrain control module storing instructions in non-transitory memory, the instructions executable to:

receive a request to crank the engine for a standard duration; and responsive to an engine soak time being greater than a threshold soak time and at least one of an engine oil temperature, an ambient air temperature, and an engine coolant temperature being less than a respective threshold temperature, crank the engine for an extended duration greater than the standard duration.

8. The system of claim 7, further comprising an engine oil pressure sensor communicably coupled to the powertrain control module, wherein the instructions are further executable to:

receive a signal from the engine oil pressure sensor, the signal indicative of a pressure of the amount of engine oil; and enable fueling of the engine upon determination of the pressure reaching a threshold pressure.

9. The system of claim 8, wherein the instructions are further executable to:

receive a volumetric flow rate of the amount of engine oil;

estimate a portion of the amount of engine oil filling cavities of the plurality of camshaft phasers based on the volumetric flow rate; and determine the threshold pressure based on when the portion of the amount of engine oil filling the cavities of the plurality of camshaft phasers is predicted to reach a threshold portion.

10. The system of claim 9, wherein the threshold portion is a portion of the amount of engine oil expected to prevent rattle of the plurality of camshaft phasers upon flowing to the cavities of the plurality of camshaft phasers.

11. The system of claim 7, wherein the instructions are further executable to:

receive a volumetric flow rate of the amount of engine oil;

estimate a portion of the amount of engine oil filling cavities of the plurality of camshaft phasers based on the volumetric flow rate;

determine a threshold duration for cranking the engine based on the engine soak time and the at least one of the engine oil temperature, the ambient air temperature, and the engine coolant temperature; and cease cranking prior to or upon the threshold duration elapsing.

12. The system of claim 11, further comprising an engine oil flow sensor communicably coupled to the powertrain control module, wherein receiving the volumetric flow rate comprises receiving a signal from the engine oil flow sensor, the signal indicative of the volumetric flow rate.

13. The system of claim 11, wherein receiving the volumetric flow rate comprises estimating the volumetric flow rate based on a change in pressure of a portion of the amount of the engine oil flowing along an engine oil flow path.

14. The system of claim 7, further comprising a starter device configured for cranking the engine, the starter device being a starter motor, a belt integrated starter generator, or a crank integrated starter generator, wherein cranking the engine for the extended duration is initiated via actuation of the starter device.

* * * * *